US009335663B2

(12) United States Patent
Abe et al.

(10) Patent No.: US 9,335,663 B2
(45) Date of Patent: May 10, 2016

(54) SEAL, CLEANING UNIT WITH SEAL, TRANSFER UNIT WITH SEAL, DEVELOPING UNIT WITH SEAL, PROCESS CARTRIDGE WITH SEAL, IMAGE FORMING APPARATUS WITH SEAL, AND IMAGE FORMING METHOD

(71) Applicants: Kyoko Abe, Osaka (JP); Tomohiro Kubota, Osaka (JP); Takahiro Sanada, Hyogo (JP); Yuji Nagatomo, Osaka (JP)

(72) Inventors: Kyoko Abe, Osaka (JP); Tomohiro Kubota, Osaka (JP); Takahiro Sanada, Hyogo (JP); Yuji Nagatomo, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/589,949

(22) Filed: Jan. 5, 2015

(65) Prior Publication Data

US 2015/0192882 A1 Jul. 9, 2015

(30) Foreign Application Priority Data

Jan. 6, 2014 (JP) ..... 2014-000471

(51) Int. Cl.
*G03G 15/08* (2006.01)
*G03G 15/16* (2006.01)

(52) U.S. Cl.
CPC ..... *G03G 15/0898* (2013.01); *G03G 15/161* (2013.01)

(58) Field of Classification Search
CPC ..... G03G 15/0898; G03G 15/161
See application file for complete search history.

(56) References Cited

U.S. PATENT DOCUMENTS

| | | | | |
|---|---|---|---|---|
| 5,634,177 | A * | 5/1997 | Taguchi et al. | 399/103 |
| 6,144,820 | A * | 11/2000 | Ishii et al. | 399/90 |
| 2003/0075874 | A1* | 4/2003 | Inamura et al. | 277/593 |
| 2004/0063018 | A1* | 4/2004 | Silence et al. | 430/108.4 |
| 2004/0208668 | A1* | 10/2004 | Kurihara et al. | 399/102 |
| 2009/0110430 | A1 | 4/2009 | Kubota et al. | |
| 2009/0290900 | A1* | 11/2009 | Maeda et al. | 399/103 |
| 2012/0014710 | A1* | 1/2012 | Kobayashi et al. | 399/101 |
| 2012/0275815 | A1* | 11/2012 | Koyama et al. | 399/102 |
| 2013/0053786 | A1* | 2/2013 | Maeda et al. | 604/187 |
| 2013/0236217 | A1 | 9/2013 | Nagatomo et al. | |
| 2014/0050502 | A1 | 2/2014 | Tsuritani et al. | |
| 2014/0050507 | A1 | 2/2014 | Hamada et al. | |
| 2014/0153958 | A1 | 6/2014 | Ogata et al. | |
| 2014/0153972 | A1 | 6/2014 | Tsuritani et al. | |

FOREIGN PATENT DOCUMENTS

| | | |
|---|---|---|
| JP | 3-039980 | 2/1991 |
| JP | 8-254896 | 10/1996 |
| JP | 2000-181220 | 6/2000 |
| JP | 2006-258907 | 9/2006 |
| JP | 2006-259469 | 9/2006 |

OTHER PUBLICATIONS

U.S. Appl. No. 14/287,345, filed May 27, 2014.

* cited by examiner

*Primary Examiner* — Sandra Brase
(74) *Attorney, Agent, or Firm* — Duft Bornsen & Fettig LLP

(57) ABSTRACT

A seal is provided to contact a rotating body installed in an image forming apparatus. Pencil hardness of the sealing element is about 2H or more and a water drop contact angle thereof is about 90 degrees or more.

14 Claims, 13 Drawing Sheets

FIG. 5

| | SEAL MATERIAL | PENCIL HARDNESS | SURFACE ROUGHNESS | THERMAL CONDUC-TIVITY | CONTACT ANGLE | CONTACT PRESSURE AGAINST DEVELOPING ROLLER | WIDTH OF NIP BETWEEN SEAL AND DEVELOPING ROLLER | TONER MATERIAL | LONGITUDINAL STRIPE GENERATING NUMBER OF SHEETS |
|---|---|---|---|---|---|---|---|---|---|
| COM-PARATIVE EXAMPLE 1 | OTHER THAN FLUORINE RESIN<br>PET | H OR LESS | 0.12 | 3×10^−4Cal/cm·sec·°C | 85 OR LESS | 25N/m | 2mm | VINYL POLYMER RESIN | 10000 |
| COM-PARATIVE EXAMPLE 2 | FLUORINE RESIN<br>PTFE | H OR LESS | 0.17 | 4×10^−4Cal/cm·sec·°C OR MORE | 90 OR MORE | ↑ | 4mm | ↑ | 5000 |
| COM-PARATIVE EXAMPLE 3 | FLUORINE RESIN<br>SURFACE ANTI-FOULING COAT AGENT | 2H OR MORE | 0.08 | 4×10^−4Cal/cm·sec·°C OR MORE | 90 OR MORE | ↑ | 1mm | ↑ | ∞ (ABSENT) |

SEAL, CLEANING UNIT WITH SEAL, TRANSFER UNIT WITH SEAL, DEVELOPING UNIT WITH SEAL, PROCESS CARTRIDGE WITH SEAL, IMAGE FORMING APPARATUS WITH SEAL, AND IMAGE FORMING METHOD

CROSS-REFERENCE TO RELATED APPLICATION

This patent application is based on and claims priority pursuant to 35 U.S.C. §119(a) to Japanese Patent Application No. 2014-000471, filed on Jan. 6, 2014 in the Japan Patent Office, the entire disclosure of which is hereby incorporated by reference herein.

BACKGROUND

1. Technical Field

Embodiments of this invention relate to a seal that contacts a moving body provided in an image forming apparatus, a cleaning unit with the seal, a transfer unit with the seal, a developing unit with the seal, a process cartridge with the seal, an image forming apparatus with the seal, and a method of forming an image with the seal.

2. Related Art

In an image forming apparatus that employs electronic photography, multiple rotating bodies are sometimes employed to attract toner to respective surfaces thereof. To seal each of the multiple rotating bodies, a seal is provided to contact a surface of the rotating body. For example, the seal is installed around a developer bearer as a rotating body that supplies developer to a latent image formed on an image bearer. In terms of preferable sealing, it is favorable for the seal to contact the rotating body intensively. However, toner adhering to the surface and then scraped off from the developer bearer generally either scatters or melts, thereby firmly adhering to a contact section of the seal depending on the type of toner. Hence, it is difficult to strike the optimum balance between providing a good seal and preventing scattered/melted toner buildup.

To suppress such sticking of the toner to the contact section of the seal that contacts a surface of a developing roller (as a developer bearer), a prescribed sheet-like member made of different material from that of the seal is pasted onto the seal to contact the developing roller. Alternatively, properties of the seal are specifically chosen to suppress the sticking of the toner thereto.

SUMMARY

Accordingly, one aspect of the present invention provides a novel seal that contacts a rotating body installed in an image forming apparatus. Pencil hardness of the seal is about 2H or more and a water drop contact angle thereof is about 90 degrees or more.

Another aspect of the present invention provides a novel image forming apparatus that includes a rotating body and at least one of a developing unit, a cleaning unit, and a transfer belt cleaning unit detachably attached thereto each including a housing and a seal to seal the housing by contacting the rotating body. Pencil hardness of the seal is about 2H or more and a water drop contact angle thereof is about 90 degrees or more.

Yet another aspect of the present invention provides a novel method of forming an image comprising the steps of forming a latent image on an image bearer, developing the latent image into a toner image, transferring the toner image onto a recording sheet, fixing the toner image on the recording sheet, and cleaning the image bearer after the toner image is transferred onto the recording sheet. The steps of developing the latent image and cleaning the image bearer are executed by using at least one of a developing unit and a cleaning unit each having a housing and a seal providing in the housing to seal the housing by contacting a rotating body. The seal has pencil hardness of about 2H or more and a water drop contact angle of about 90 degrees or more.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein:

FIG. 5 is a diagram illustrating a result of investigation of the number of sheets firstly generating an image with a vertical stripe due to toner adhesion executed when each of seals of comparative examples 1, 2, and 3 is used as an entrance seal;

DETAILED DESCRIPTION

Figure 1:
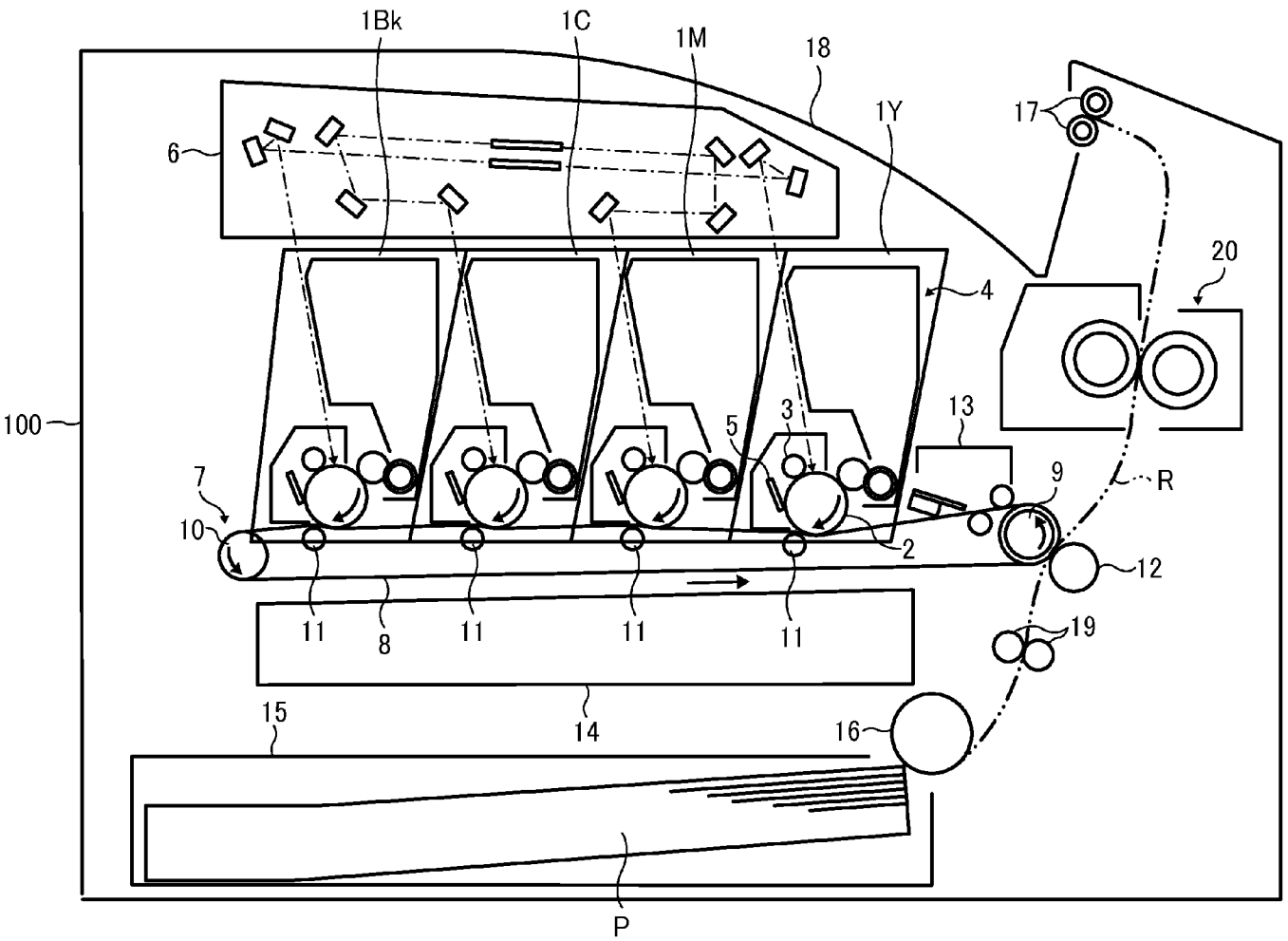
FIG. 1 is a block diagram schematically illustrating an exemplary image forming apparatus according to one embodiment of the present invention.

Although the above-described approaches specify the properties of the seal to lessen the sticking of toner thereto, the toner adhesion still occurs depending on the type of toner. Then, applicable one or more embodiments of the present invention described herein below are configured to achieve good sealing performance while preventing adhesion of toner at a contact surface contacting a rotating body.

Referring now to the drawings, wherein like reference numerals designate identical or corresponding parts throughout the several views thereof. In short, according to the below described various embodiments of the present invention, since properties of a seal that contacts a rotating body placed in an image forming apparatus are specified as described below, preferable sealing performance can be obtained while preventing toner from sticking to the rotating body at a contact surface therebetween. Specifically, as seal properties of the seal, pencil hardness is about 2H or more and a water drop contact angle is about 90 degrees or more. Further, the seal is made of fluorine resin. Surface roughness (i.e., arithmetic mean roughness) Ra of the seal is about 0.10 or less. Thermal conductivity of the seal is about $4\times10^{-4}$ [Cal/cm·sec·degrees Celsius] or more. As a rotating body contacted by the seal with the above-described configuration, a developing roller that bears one-component toner as a developer bearer, a developing sleeve that bears two-component developer containing toner and carrier as a developer bearer, a photoconductive drum or a photoconductive belt that bears an electrostatic latent image formed thereon as an image bearer, and a transfer belt onto which a toner image is transferred as a transfer member are exemplified.

As an image forming apparatus to which the seal according to one embodiment of the invention is applied, a monochromatic image forming apparatus that forms a monochrome image by using monochrome toner and a color image forming apparatus that forms a color image by using at least two colors of toner out of yellow, magenta, cyan, and black are exemplified. As various devices employed in the image forming apparatus, to which the seal of the present invention is applied, a developing unit that uses either single-component toner (i.e., one-component developer) or two-component developer, a photoconductive drum cleaning unit that cleans either a photoconductive drum or a photoconductive belt, and a transfer belt cleaning unit that cleans a transfer belt are exemplified. However, the device to which the seal according to one embodiment of the present invention is applied is not limited to the image forming apparatus, the developing unit, the photoconductive drum cleaning unit, and the transfer belt cleaning unit, and a process cartridge with at least one of the developing unit, the photoconductive drum cleaning unit, and the transfer belt cleaning unit is included as well, for example.

When a seal is applied to a developing unit or a developing sleeve, a width of a contact nip formed between the developing roller or the developing sleeve and a sheet member (the seal) is preferably adjusted to range from about 0.5 mm to about 2 mm. Also, a contact pressure generated between the developing roller or the developing sleeve and the sheet member (the seal) is preferably adjusted to range from about 10 N/m to about 45 N/m. According to various embodiments of the present invention, even when as single or two-component developer particles, so-called low-melting toner including inorganic oxide (mainly including silica) as external additive by about 2% or more and having a glass transition point at about 60 degrees Celsius or less is utilized in the developing unit of the image forming apparatus, toner adhesion to a contact section (of the seal) can be prevented, because properties of the seal are specified as described above. However, the present invention is not limited to the seal, the developing unit, the various cleaning units, the process cartridge, and the image forming apparatus, and includes an image forming method of forming a monochrome image by using at least one of the developing unit, the various cleaning units, and the process cartridge as well.

FIG. 1 indicates a developing unit on which a seal according to one embodiment of the present invention is mounted and an image forming apparatus with the developing unit. The image forming apparatus is a color laser printer that includes four process cartridges 1Y, 1M, 1C, and 1Bk detachably attached to an apparatus body 100 of an image forming apparatus as image forming units. Each of the process cartridges 1Y, 1M, 1C, and 1Bk is similarly configured to each other except for developer color (i.e., a component color of yellow (Y), magenta (M), cyan (C), black (Bk) of a color image). Here, in this embodiment, as developer, a single-component developer including toner (hereinafter referred to as toner) is used.

The respective process cartridges 1Y, 1M, 1C, and 1Bk include photoconductive drums (hereinafter referred to as photoconductive members) 2 as image bearers, electric charging devices electrically charging surfaces of the photoconductive drums 2 with charging rollers 3, developing units 4 to supply toner to the surfaces of the photoconductive drums 2, and cleaning units for cleaning the surfaces of the photoconductive drums 2 with cleaning blades, etc. The photoconductive drum 2 is configured from an element tube made of aluminum coated with a photoconductive layer as a drum-shaped photoconductive member. Here, as shown in FIG. 1, reference signs are only assigned to devices of the yellow process cartridge 1Y. That is, the photoconductive drum 2, the electric charging rollers 3, the developing unit 4, and the cleaning blade 5 in the yellow process cartridge 1Y only include reference signs, and those of the other process cartridges 1M, 1C, and 1Bk do not (i.e., omitted).

As shown in FIG. 1, above the process cartridges 1Y, 1M, 1C, and 1Bk, an exposing unit 6 is provided to expose the respective surfaces of the photoconductive drums 2 to light beams. The exposing unit 6 includes a light source, a polygon mirror, an f-theta lens, and reflectors, or the like, and is configured to emit an exposure light beam from the light source to the surface of each of the photoconductive drums 2 based on image data. As the light source, the exposing unit 6 can employ an LED (light emitting diode) optical device having a light emitting diode (LED) and an optical device such as a lens, etc. The exposing unit 6 can otherwise employ an LD optical device having a laser diode (LD) and an optical device such as a lens, etc., as the light source. The transfer unit 7 is disposed below the process cartridges 1Y, 1M, 1C, and 1Bk and includes an intermediate transfer belt 8 including an endless transfer belt. The intermediate transfer belt 8 is stretched by and suspended around multiple supporting members of a driving roller 9 and a driven roller 10. The intermediate transfer belt 8 is configured to run and circulate (i.e., rotate) in a direction as shown by arrow in FIG. 1 (i.e., counterclockwise in the drawing) when the driving roller 9 rotates counterclockwise in the drawing.

Four primary transfer rollers 11 are opposed to the four photoconductive drums 2 as primary transfer units, respectively. The primary transfer rollers 11 partially press an inner circumferential surface of the intermediate transfer belt 8 against the respective photoconductive drums 2 opposed thereto, and form primary transfer nips at positions between the intermediate transfer belt 8 and the photoconductive drums 2 contacting with each other. Each of the primary transfer rollers 11 is connected to a power source, not shown, to receive a transfer bias composed of a given DC voltage (DC) and/or an alternating current voltage (AC) therefrom.

At a position opposed to the driving roller 9, a secondary transfer roller 12 is disposed as a secondary transfer unit. The secondary transfer roller 12 contacts an outer circumferential surface of the intermediate transfer belt 8 with pressure, and forms a secondary transfer nip at a contact section between the secondary transfer roller 12 and the intermediate transfer belt 8 contacting with each other. The secondary transfer roller 12 is similarly connected to the power supply, not shown, as the primary transfer roller 11, and is configured to receive a second transfer bias composed of a given DC voltage (DC) and/or an alternating current voltage (AC) therefrom.

A belt cleaning unit 13 is provided adjacent to a right side surface of the intermediate transfer belt 8 as shown in FIG. 1 to clean the surface of the intermediate transfer belt 8. A waste toner transferring hose, not shown, extends from the belt cleaning unit 13 and connects with an entrance of a waste toner container 14 disposed below the transfer unit 7.

The sheet feeding tray 15 storing an image transferred member P, such as a sheet, a transparency (OHP (overhead projector)) sheet, etc., is disposed at a bottom of the apparatus body 100. A sheet feeding roller 16 is disposed in the sheet feeding tray 15 to send the image transferred member P stored therein. At a top of the apparatus body 100, a pair of sheet ejection rollers 17 and a sheet ejection tray 18 are provided to eject the image transferred member P to an outside and stack the image transferred member P discharged by the pair of sheet ejection rollers 17, respectively.

In the apparatus body 100, a sheet conveying path R is disposed to convey the image transferred member P from the sheet feeding tray 15 to the sheet ejection tray 18 through secondary transfer nip. In the sheet conveying path R, a pair of registration rollers 19 is disposed upstream of the secondary transfer roller 12 in the transferred member conveying direction. Further, a fixing unit 20 is disposed downstream of the secondary transfer roller 12 in the image transferred member conveying direction.

The above-described image forming apparatus operates as described below. When image forming operation starts, the respective photoconductive drums 2 in the process cartridges 1Y, 1M, 1C, and 1Bk are driven and rotated clockwise in FIG. 1, and the surfaces of the photoconductive drums 2 are electrically charged uniformly by the charging rollers 3 each to have a prescribed polarity. Based on either image information read from an original document by a reading unit, not shown, or image information transmitted from a PC (personal computer), a laser light beam is irradiated from the exposing unit 6 to each of charged surfaces of the photoconductive drums 2, so that an electrostatic latent image is formed on each of the surfaces of the respective photoconductive drums 2. Image information in the respective exposure light beams emitted to the photoconductive drums 2 are monochromatic image information obtained by dissolving a given full-color image into respective color information of yellow, magenta, cyan, and black. As the respective developing units 4 supply toner particles to the electrostatic latent images formed on the photoconductive drums 2, the electrostatic latent images are rendered visible to be toner images (i.e., in an image visualization process).

Subsequently, the driving roller 9 stretching and suspending the intermediate transfer belt 8 rotates and thereby letting the intermediate transfer belt 8 to run and circulate counterclockwise as shown in the drawing. Here, a first transfer bias composed of either a constant voltage or current having an opposite polarity to a polarity of electrically charged toner or a bias prepared by superimposing a DC and an AC is applied to each of the primary transfer rollers 11. Accordingly, multiple transfer fields are formed in the respective primary transfer nips between the primary transfer rollers 11 and the photoconductive drums 2. Subsequently, the toner images of respective colors on the photoconductive drums 2 are transferred and superimposed successively on the intermediate transfer belt 8 in the transfer fields formed in the primary transfer nips. Consequently, the intermediate transfer belt 8 bears the full-color toner image on its surface. Here, the toner particles not transferred onto the intermediate transfer belt 8 from the photoconductive drums 2 remaining thereon are removed therefrom by the respective cleaning blades 5.

On the other hand, as the image forming operations starts, the sheet feeding roller 16 rotates and conveys an image transferred member P from the sheet feeding tray 15. The image transferred member P conveyed in this way is timed by the pair of registration rollers 19 and is then sent to the secondary transfer nip formed between the intermediate transfer belt 8 and the secondary transfer roller 12. At this moment, to the secondary transfer roller 12, a secondary transfer bias composed of either a constant voltage or current having an opposite polarity to that of electrically charged toner in the toner image borne on the intermediate transfer belt 8 or a bias prepared by superimposing AC and DC with each other. With this, a transfer field is accordingly formed in the secondary transfer nip. Subsequently, the toner image of full-color borne on the intermediate transfer belt is transferred in the transfer field formed in the secondary transfer nip, onto an image transferred member P at once. Subsequently, the image transferred member P is sent to the fixing unit 20, and the toner image is then fixed onto the image transferred member P. The image transferred member P with the fixed image thereon is then discharged by the pair of sheet ejection rollers 17 onto the sheet ejection tray 18.

Hence, the above-described image forming operation generates a full-color image on the image transferred member P. However, a monochromatic image can be formed only by using one of the four process cartridges 1Y, 1M, 1C, and 1Bk.

Further, dual or trivalent color images can be also formed by using any two or three of the process cartridges 1Y, 1M, 1C, and 1Bk.

Figure 2:
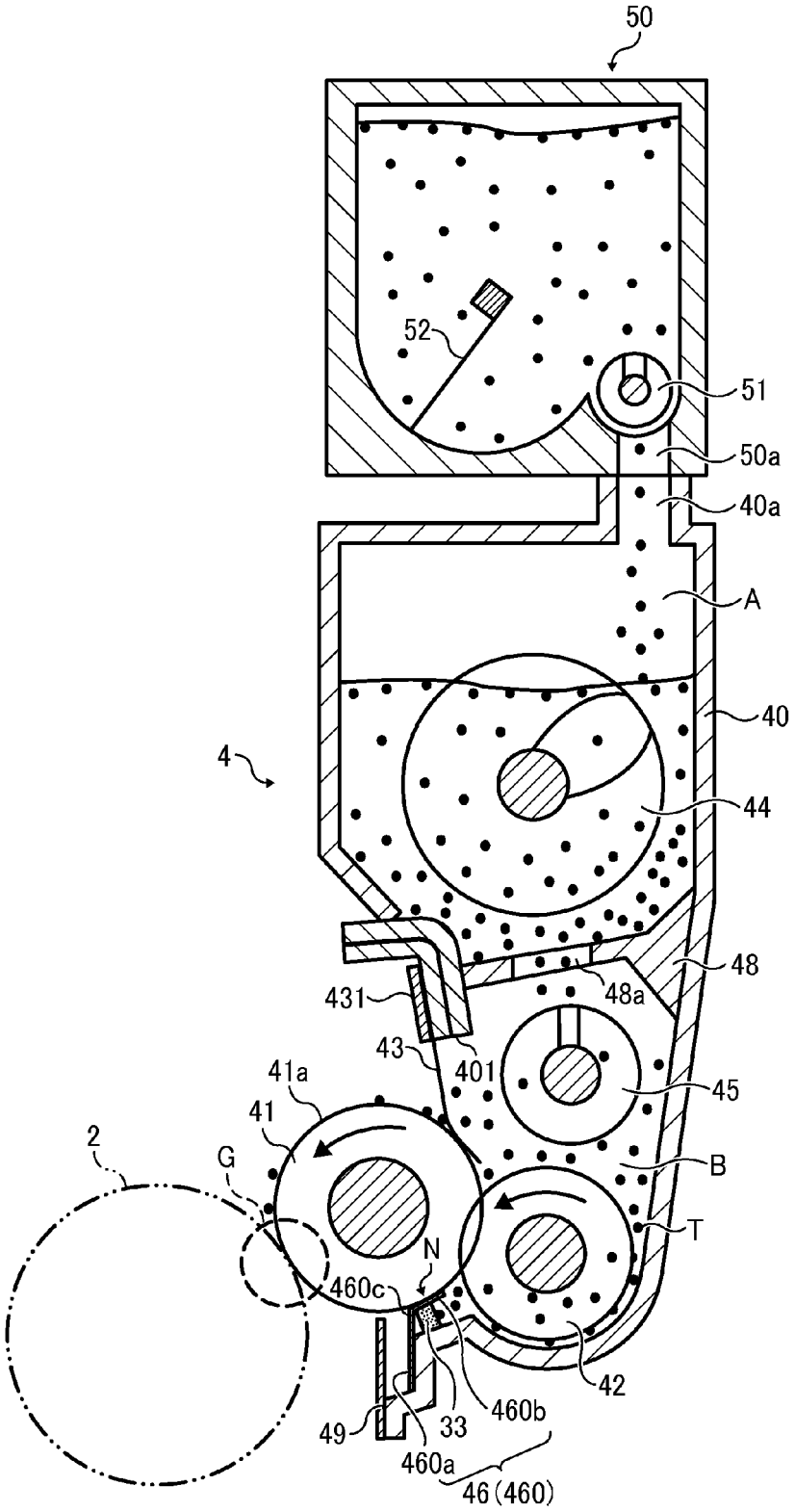
FIG. 2 is an enlarged cross-sectional view illustrating an exemplary configuration of a developing unit provided in the image forming apparatus shown in FIG. 1 according to one embodiment of the present invention.

FIG. 2 is a cross-sectional view schematically illustrating a developing unit 4 and a toner cartridge 50 according to one embodiment of the present invention. As shown there, the developing unit 4 includes a developing unit housing 40 acting as a base having a containing space to accommodate toner T as indicated by multiple black circles in the drawing. The developing unit 4 also includes a developing roller 41 acting as a developer bearer to bear toner T and a supplying roller 42 acting as a developer supplying member to supply toner T to the developing roller 41. The developing unit 4 further includes a developing blade 43 as a regulating member to regulate an amount of toner borne on the developing roller 41, first and second screws 44 and 45 acting as developer conveying members to convey toner T, and an entrance seal unit 46 as a seal section to prevent leakage of toner T from around the developing roller 41 or the like.

The developing roller 41 is configured by a metal cored bar and a conductive rubber disposed overlying the metal cored bar. In this embodiment, an outer diameter of the metal cored bar is set to about 6 mm. An outer circumference of the conductive rubber is set to about 12 mm, and hardness of the conductive rubber is about Hs 75. A volume resistivity of the conductive rubber is adjusted to range from about $10^5\Omega$ to about $10^7\Omega$. In general, the conductive rubber can be made of conductive polyurethane and silicone rubber or the like, for example. Further, below the developing unit housing 40, an opening 401 is formed to face the photoconductive drum 2 and communicates with an outside of the developing unit housing 40. The developing roller 41 is freely rotatably installed in the developing unit housing 40 with its surface 41 partially exposed to the outside of the developing unit housing 41 through the opening 401. That is, in a printing process, the developing roller 41 rotates counterclockwise as shown in FIG. 2, and conveys the toner T held on its surface 41*a* to a developing region G opposed to the photoconductive drum 2.

Further, a supplying roller 42 is provide and employs a sponge roller or the like. The sponge roller is preferably prepared from a metal cored bar and semi-conductive foam polyurethane mixed with carbon overlying a periphery of the metal cored bar. In this embodiment, an outer diameter of the metal cored bar is set to about 6 mm and that of the sponge section is set to about 12 mm. The supplying roller 42 contacts the surface 41*a* of the developing roller 41. A nip is formed between the supplying roller 42 and the developing roller 41 and ordinary includes a width of from about 1 mm to about 3 mm in a rotary direction of the developing roller 41. In this embodiment, the nip width is practically set to about 2 mm. Here, since the supplying roller 42 rotates counterclockwise in FIG. 2 against the developing roller 41, the toner T stored in the developing unit housing 40 can be efficiently supplied up to a surface of the developing roller 41. Since a ratio of the number of rotation (rpm) between the developing roller 41 and the supplying roller 42 is set about one in this embodiment, toner supplying capability can be preferably ensured.

In the developing unit housing 40, there is provided a holder 431 to reinforce the developing blade 43 including a sheet metal. One end (i.e., a base end) of the sheet metal of the developing blade 43 is fixed to the holder 431 (by one of welding, riveting, and screwing or the like thereof), while the other free end thereof contacts the surface 41*a* of the developing roller 41 with a prescribed pressure. With the contact at the other free end of the developing blade 43, a nip is formed between the developing roller 41 and the developing blade 43 to equalize (regulate) an amount of toner borne on the surface 41*a* of the developing roller 41 after the toner T passes through the nip. In this embodiment, the developing blade 43 is made of stainless steel (SUS) having a thickness of about 0.1 mm, an contact pressure calculated based on a deflection calculating formula is set to about 45 N/m, a distance from a tip of the developing blade 43 to the nip is set to about 0.2 mm, and a free length of the developing blade 43 from a supporting end to a free end (i.e., a tip) thereof is set to about to 14 mm, so that a stable thin layer of toner can be formed on the surface 41*a* of the developing roller 41.

An internal storage space of the developing unit housing 40 is divided by a partition member 48 having a through hole 48*a* into a first region A that includes a supply mouth 40*a* and a second region B that includes a developing unit, such as a developing roller 41, a developing blade 43, etc. Hence, by dividing the interior of the developing unit housing 40 using the partition member 48 in this way, powder pressure of toner is inhibited to concentrate thereby applying a large load onto the supplying roller 42. Also, in the first region A, a first screw 44 is disposed to act as a first developer conveying member. In the second region B, a second screw 45 is also disposed to act as a second developer conveying member.

Above the developing unit housing 40, a toner cartridge 50 as a developer container is detachably attached thereto to accommodate toner T to be supplied thereto. Here, the developing unit 4 and the toner cartridge 50 are not limited to the configurations as shown in FIG. 2. For example, the photoconductive drum 2 or the like can be integrated in addition to the developing unit 4 and the toner cartridge 50 as a process cartridge as well.

Between the toner cartridge 50 and the developing unit housing 40, multiple supply mouths 50*a* and 40*a* are formed to replenish the toner T stored in the toner cartridge 50 to the developing unit housing 40. In the toner cartridge 50, a third screw 51 and an agitator 52 are rotatably disposed to convey toner T stored therein to the supply mouth 50*a* and to bring the toner T near the third screw, respectively.

The toner T is supplied based on result of detection of a remaining amount of toner detected by a toner level detector, not shown, disposed in the developing unit housing 40. Specifically, when the toner T in the developing unit housing 40 is consumed, and the toner level detector detects an effect that a remaining amount of toner is below a prescribed level, the third screw 51 and the agitator 52 provided in the toner cartridge 50 are driven for a prescribed time period, so that a prescribed amount of toner T can be supplied to the developing unit housing 40.

A sheet like toner receiving member 49 is provided to avoid splashing of toner T not having contributed to development (i.e., non-developing toner T) and slightly scraped off from the surface 41*a* of the developing roller 41 by the entrance seal unit 46 by collecting and retaining the non-developing toner T within the developing unit housing 40. An entrance seal unit 46 includes a sheet (seal) member 460 to form a nip N at its a free end 460*b* by bring the a free end 460*b* in contact with the surface 41*a* of the developing roller 41 at downstream of the developing region G in a rotational direction of the developing roller 41.

Figure 3:
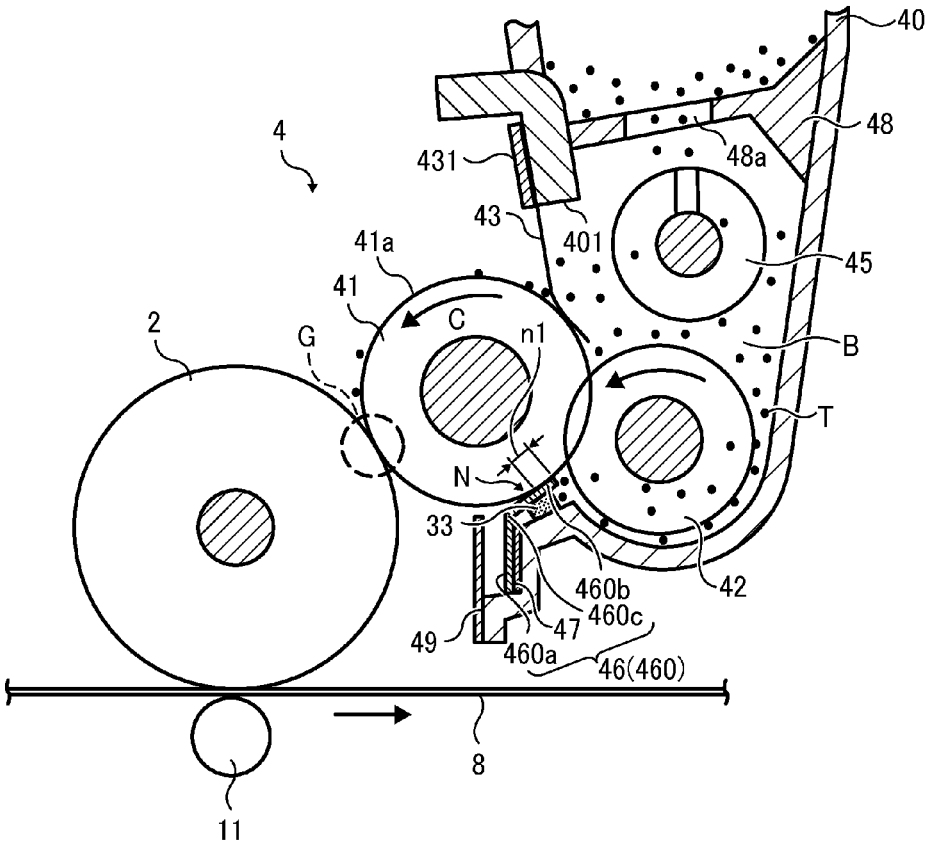
FIG. 3 is an enlarged cross-sectional view illustrating an exemplary sealing structure that employs a seal according to a first embodiment of the present invention.

In the developing unit 4 of FIG. 3, when the image forming apparatus starts printing, a developing roller 41 rotates in a direction shown by arrow C and visualizes a latent image borne on the photoconductive drum 2 with toner T in the developing region G opposed to the photoconductive drum 2. Toner non-developing toner moves as is along with rotation of the developing roller 41 and returns to an inside of the developing unit housing 40 passing through a nip N formed between the developing roller 41 and the entrance seal unit 46. Since the developing roller 41 is rotatably installed in the developing unit housing 40 while partially baring itself outside through an opening 401, a prescribed configuration is needed not to cause leakage of the toner T stored in the developing unit housing 40 via a sliding section between the developing roller 41 and the developing unit housing 40. Because of this, the entrance seal unit 46 is extended while forming a nip N in a longitudinal direction of the developing roller 41 by contacting the surface 41*a* of the developing roller 41 to prevent leakage of the toner T from inside the developing unit housing 40. However, since prevention of the toner T from leaking from inside the developing unit housing 40 is rarely achieved when contact pressure in the nip N is too small, appropriate contact pressure needs to be set.

The seal 460 of the entrance seal unit 46 is a sheet-like member made of commonly used resin such as PET, etc., having a thickness of from about 0.05 mm to about 0.15 mm. The contact pressure (of the seal) is adjusted by an amount of invasion of the sheet (sealing) member into the surface 41*a* of the developing roller 41 based on firmness of the sheet (sealing) member itself. A backup sponge member 33 is sometimes provided as a contact pressure adjustment member between a back side (of the seal 460) opposite a contact surface thereof contacting the developing roller 41 and the developing unit housing 40 to more actively regulate the contact pressure. In the developing unit 4 shown in FIG. 3, the backup sponge member 33 is practically provided.

The contact pressure applied to the surface 41*a* of the developing roller 41 by the seal 460 is preferably set to range from about 10 N/m to about 45 N/m when it is converted into a line pressure in a thrusting direction of the developing roller 41 (i.e., pressure per unit length in a thrusting direction (a longitudinal direction)). That is, when the contact pressure is lower than the above-described range, there is a risk of leaking the toner T during transportation of an image forming apparatus or a developing unit alone due to vibration or the like caused at the time. By contrast, when the contact pressure is higher than the above-described range, non-developing toner T on the developing roller 41 is scraped off in the nip N between the developing roller 41 and the seal 460 and is hardly collected and stored within the developing unit housing 40. The toner leakage caused by the vibration during the transportation is also affected by a packing condition and a transporting system of the image forming apparatus and the developing unit 4. Further, in general, since adhesion of toner T adhering onto the developing roller 41 decreases depending on durability and environment (especially, high temperature and humidity environment), non-developing toner T on the developing roller 41 can be easily scraped off under such the high temperature and humidity environment. In view of the above-described points, the above-described contact pressure is more preferably set to range from about 15 N/m to about 35 N/m.

Figure 4A:
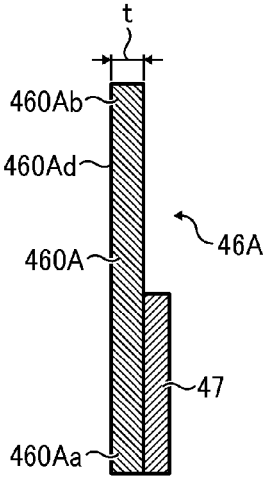
FIG. 4A is an enlarged cross-sectional view illustrating an exemplary configuration of a modification of the seal of the first embodiment according to one embodiment of the present invention.
Figure 4B:
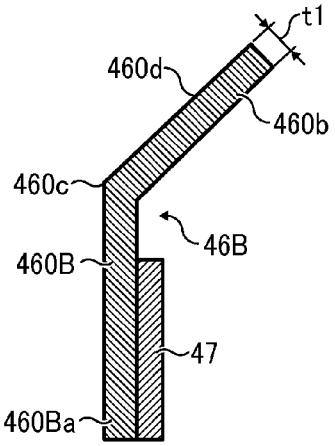
FIG. 4B is an enlarged cross-sectional view of the seal of the first embodiment of the present invention.

Now, a first embodiment of an entrance seal unit 46 is herein blow described in more detail with reference to FIG. 4B and applicable drawings. However, a thickness and a length of an entrance seal unit and a seal are exaggerated beyond real sizes of those for the sake of convenience of illustrating configurations. Specifically, as shown in FIG. 4B, the entrance seal unit 46 is composed of a sheet of seal 460B. The seal 460B is partially bent (at an angled portion 460*c*), and a double-sided tape 47 is pasted onto a base end 460Ba thereof (i.e., one side of the angled portion 460*c*). Thus, the seal 460B is attached to the developing unit housing 40 by the double-sided tape 47. The a free end 460*b* of the angled portion 460*c* of the seal 460 contacts the surface 41*a* of the developing roller 41 with pressure. Thus, since rigidity of the sheet (sealing) member 460 with the angled portion 460*c* decreases, the contact pressure in the nip N is accordingly degraded. To appropriately set the contact pressure and solve such a problem, a backup sponge member 33 is installed and brought in contact with both the developing unit housing 40 and the seal 460 therebetween. In such a situation, since it is additionally adjusted by the backup sponge member 33 by changing properties thereof (e.g., hardness, thickness of the sponge, or the like), the contact pressure can be more precisely adjusted. However, since a bending process is applied to the thin seal 460, a bending angle is not constant in the bending process. For this reason, a thickness t1 of the seal 460 of FIG. 4B is preferably from about 0.8 mm to about 0.15 mm.

Now, various properties of a seal that constitutes the entrance seal unit 46 are described with reference to FIG. 5. FIG. 5 is a table illustrating a result of investigation of the number of sheets that causes a vertical stripe in an image for the first time due to toner adhesion during printing, executed by installing each of first to third comparative examples of seals in an image forming apparatus in turn. Specifically, these seals of the first to third comparative examples are each molded to have the following values of material, hardness, surface roughness, and thermal conductivity as properties thereof. As installation conditions of the seal, a contact pressure against a rotating body, a contacting angle formed between the rotating body, and a nip width formed between the rotating body and a seal, etc., are employed. Here, a developing roller 41 serves as the rotating body. As listed in a column indicating the type of toner, toner used in a developing process is made of vinyl polymerization resin. As listed in a column indicating material of a sheet (sealing) member, a first comparative example is made of material other than fluorine resin, such as polyethylene terephthalate resin (hereinafter simply referred to as PET). A second comparative example is made of fluorine resin such as polytetrafluoroethylene-4-polytetrafluoroethylene resin (hereinafter simply referred to as PTFE). A third comparative example is made of fluorine resin with surface stain-proof coating agents. As also listed in a column indicating hardness, pencil hardness (JIS K5600-5-4) is used, and the first to third comparative examples have pencil hardness of H or less, H or less, and 2H or more, respectively. As also listed in a column indicating surface roughness, arithmetic mean roughness Ra is used, and Ra of the first to third comparative examples are about 0.12 (Ra=0.12), about 0.17 (Ra=0.17), and about 0.08 (Ra=0.08), respectively. As also listed in a column indicating thermal conductivity, respective thermal conductivities of the first to third comparative examples are about 1.3×10^−4 [Cal/cm·sec·degree Celsius], about 2.4×10^−4 [Cal/cm·sec·degree Celsius], and about 3.4×10^−4 [Cal/cm·sec·degree Celsius]. As also listed in a column indicating a contacting angle, respective contacting angles of the first to third comparative examples are about 85 degrees or less, about 90 degrees or more, and about 90 degrees or more. As also listed in a column indicating a contact pressure, each of respective amounts of contact pressure of the first to third comparative example is about 25 N/m. As also listed in a column indicating a nip width, respective nip widths of the first to third comparative examples are about 2 mm, about 4 mm, and about 1 mm. As also listed in a column indicating investment environment, each of respective investment environments (i.e., temperature and humidity) of the first to third comparative examples is about 23 degrees Celsius and 50%.

Here, there are several examples of a toner adhesion mechanism as described below. In a (first toner adhesion mechanism), friction occurs between a developing roller and a seal while generating heat therebetween. Accordingly, toner melts being deformed and is ultimately secured to the seal. In a second toner adhesion mechanism, the seal is shaven by friction caused in a nip between the seal and the developing roller while forming a dent thereon. Consequently, toner enters the dent and firmly adheres thereto.

In the first comparative example of FIG. 5, since it is mainly made of PET with low thermal conductivity, reduced mold releasing performance, and a contacting angle of about 85 degrees or less, the seal easily generates frictional heat and accordingly the toner adhesion of the first mechanism. Actually, when about 10,000 numbers of sheets have been printed under conditions of room temperature of about 23 degrees Celsius and humidity of about 50%, a vertical stripe occurs in an image due to the toner adhesion thereto. Whereas in the second comparative example of FIG. 5, since it is made of fluorocarbon polymer (with pencil hardness of about H or less) sufficiently high mold releasing performance and heat conductivity, relatively poor surface roughness and hardness than the first comparative example, a surface of the seal (of the comparative example 2) is easily scraped off, so that toner is embedded in the surface thereof thereby causing the toner adhesion of the second toner adhesion mechanism. Especially, since toner used in the investigation is prepared by externally adding inorganic oxide (mainly including silica) by 2% or more, cutting force caused by sliding friction is intensive. Since although thermal conductivity of the seal (of the comparative example 2) is higher than that of the first comparative example, a nip thereof is wider than that of the first comparative example, frictional heat is prone to occur thereby easily causing first toner adhesion mechanism. Actually, when about 5,000 numbers of sheets have been printed under conditions of room temperature of about 23 degrees Celsius and humidity of about 50%, the vertical stripe occurs in an image due to the toner adhesion thereto. In a third comparative example of FIG. 5, since a seal of this example is made of fluorine resin coated with surface stain-proof coating member (having pencil hardness of about 2H or more) and better mold releasing performance and thermal conductivity, toner rarely melts. Also, since the seal of this example has a lower surface roughness, and more intensive surface scratch resistance as well than those of the above-described first and second comparative examples, a surface of the seal (of the third comparative example) is rarely scraped off and accordingly the toner is hardly embedded in the surface thereof. Actually, when about 5,000 numbers of sheets have been printed under conditions of room temperature of about 23 degrees Celsius and humidity of about 50%, the vertical stripe generally caused by the toner adhesion does not occur.

Figure 6A:
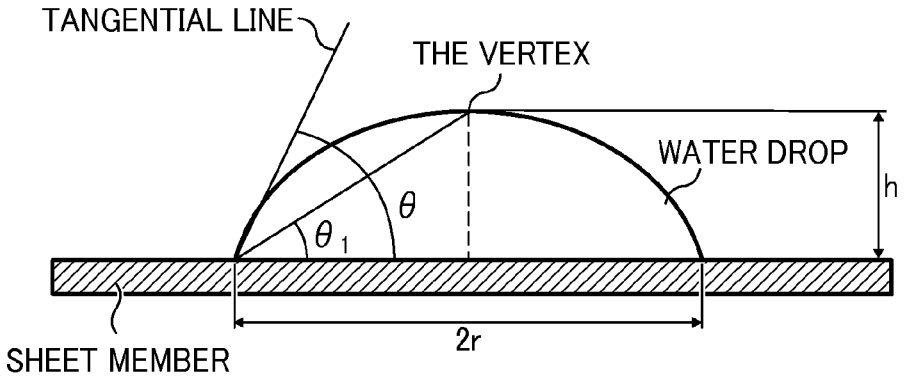
FIGS. 6A and 6B are diagrams schematically illustrating an exemplary method of measuring mold releasing performance of a sheet (sealing) member collectively according to one embodiment of the present invention.
Figure 6B:
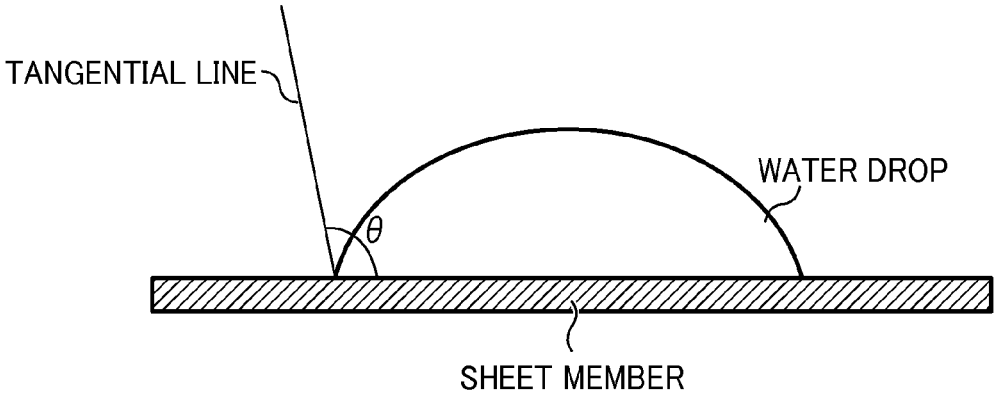

Now, a method of measuring a contacting angle is described with reference to FIGS. 6A and 6B. FIGS. 6A and 6B are diagrams schematically illustrating an exemplary method of measuring mold releasing performance of a sheet (sealing) member, collectively. As a contacting angle measuring device, a model of DM-500 manufactured by Kyowa Interface Science Co., Ltd., is used. A contacting angle is measured as described below. As shown in FIG. 6A, water drop is initially created and is dropped onto a measuring target sample (i.e., a seal). When one second has elapsed after the water drop has landed thereon, an angle θ made by the water drop and the sample (i.e., the seal) is measured. The contacting angle is then calculated by using a θ/2 method. Here, the θ/2 method is utilizes such that a radius r and a height h of a drop are sought and are substituted for corresponding members in the below described expression to seek the contacting angle.

$$\tan \theta_1 = h/r \rightarrow \theta = 2 \arctan(h/r) \quad \text{(First Formula)}$$

Here, the higher the contacting angle θ, the lower wetting performance and the higher mold releasing performance as well as shown in FIG. 6B.

Hence, as indicated in the first to third comparative examples, when multiple seat members are molded using different material from each other, it is found that a seat member with properties of the third comparative example can avoid occurrence of the vertical stripe in an image generally caused by the toner adhesion thereto. That is, as properties of the sheet (seal) member according to one embodiment of the present invention, the pencil hardness is preferably about 2H or more, the water drop contact angle is preferably about 90 degrees or more, the material is preferably fluoride resin, the surface roughness (e.g., arithmetic average roughness) Ra is preferably about 0.10 or less, and the thermal conductivity is preferably about 4×10^−4 [Cal/cm·sec·degree Celsius] or more. Then, a sheet (seal) member with the above-described properties is molded and is brought in contact with the surface 41*a* of the developing roller 41 as the seal 460 of the entrance seal unit 46 in the developing unit 4 as illustrated in FIGS. 2 and 3. At this moment, as contact conditions of the sheet (seal) member, a width of a contact nip n1 formed between of a free end 460*b* of the sheet (sealing) member 460 and the surface 41*a* of the developing roller 41 is set to about 0.5 mm to about 2 mm while setting the contact pressure to from about 10 N/m to about 45N/m so that toner leakage from the contact section can be prevented to ensure sealing performance.

As shown in FIG. 4B, an angled portion 460*c* is formed in a sheet of the seal 460 by partially bending the seal 460. A contact surface 460*d* is provided at an end 460*b* of the angled portion 460*c* and is brought in contact with the surface 41*a* of the developing roller 41. However, the seal 460 is not limited to such a bending shape, and includes another type. For example, as shown in FIG. 4A, like an entrance seal unit 46A, a double-sided tape 47 to be pasted onto the developing unit housing 40 is pasted onto a base end 460Aa of a sheet of the seal 460*a*, while an opposite side (of the sheet of the seal 460*a*) to a side onto which the double-sided tape 47 is pasted may be kept in contact with the surface 41*a* of the developing roller 41 at the free end 460Ab. Hence, with the entrance seal unit 46A in which only one sheet of the seal 460*a* is pasted onto the developing unit housing 40 in this way, contact pressure in the nip N is determined based on properties of material of the seal 460*a* (a level of rigidity) and an invasion amount of the seal 460*a* invading the developing roller 41. However, since the contact pressure becomes higher than a prescribed suitable level when rigidity of it is too great, a thickness t of the seal 460A is preferably from about 0.05 mm to about 0.12 mm. In addition, by determining properties of the sheet (sealing) member 460*a* such that pencil hardness is about 2H or more, a contacting angle of water drop is about 90 degrees or more, material is fluorocarbon resin, a surface roughness (arithmetic mean roughness) Ra is about 0.10 or less, and thermal conductivity is about 4×10^−4 [Cal/cm·sec·degree Celsius] or more, a vertical stripe generally caused by toner adhesion can be likely prevented. Further, by preferably setting both of a width n1 of the contact nip formed between a contact surface 460Ad of the sheet (sealing) member 460*a* and the surface 41*a* of the developing roller 41 and the contact pressure as contact conditions of the sheet (sealing) member 460*a* to from about 0.5 mm to about 2 mm and from about 10 N/m to about 45 N/m, respectively, the toner leakage from the contact section can be likely prevented while ensuring the sealing performance.

In the entrance seal units 46A and 46B shown in FIGS. 4A and 4B, even though the contact pressure in the nip N is set to from about 10 N/m to about 45 N/m (more preferably, from about 15 N/m to about 35 N/m), several problems may yet occur from a point of durability view. That is, as a first problem, the entrance seal itself wares away hereby creating roughness or grooves on the surface thereof as time elapses. When such (roughness and) grooves are created, toner particles T are caught by the roughness and the grooves and firmly stick thereto (i.e., a phenomenon of melting and hardening of toner). When it firmly adheres (to the entrance seal), the toner T damages the surface 41*a* of the developing roller 41. Consequently, an unusual image, such as a stripe image, an uneven image, etc., is sometimes generated in a rotational direction of the developing roller 41. As a second problem, when toner T is degraded as time elapses, chargeability of the toner T decreases, thereby causing dirt (i.e., background fog) in an image. Since these two problems are different challenges to be selectively resolved depending on properties of usage parts and a product (e.g., physical properties of a developing roller, properties of toner, etc.,) and a specification of a developing unit (e.g., setting of life time, usage environment, etc.,), a function expected to the entrance seal unit is different accordingly.

As a counter measure against the first problem, the entrance seal unit is preferably made of durable material having constant surface properties. For example, the sheet (the entrance seal) is made of either Polycarbonate Methylene having excellent abrasion resistance or Teflon® having excellent sliding property. As a counter measure against the second problem which improves the background fog, the entrance seal is made of conductive material (such as conductive PTFE, etc.,) while compensating chargeability of the toner T passing through the nip N by applying a bias voltage thereto.

In this way, in accordance with the specification of the system or the products, the entrance seal is selectively made of different material. However, when the entrance seal is changed from the PET (Polyethylene Terephthalate) sheet to a seal made of POM (Polyoxymethylene), a Teflon® sheet, or a conductive PTFE (Polytetrafluoroethylene) and the like, contact pressure set previously cannot be maintained by the seal alone or together with the backup sponge member 33 because rigidity of material of each of the seals is different from each other. For example, (when the contact pressure of the entrance seal has been set to from about 10 N/m to about 45N/m (more preferably, from about 15 N/m to about 55 N/m) by using the typical PET sheet, and is replaced with a seal made of more stiff POM, the contact pressure significantly increases.

Figure 7:
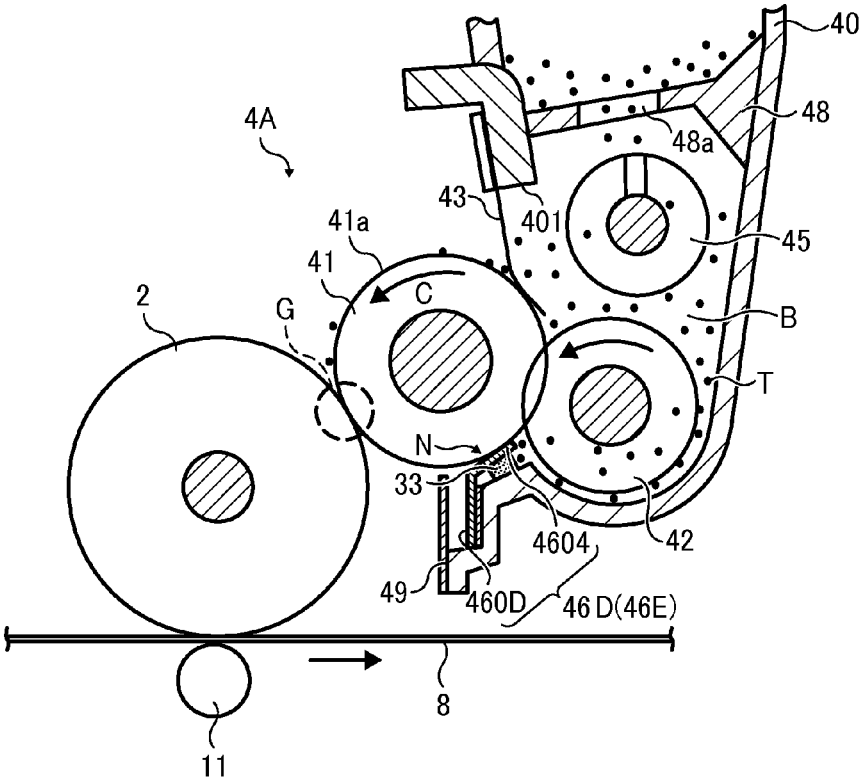
FIG. 7 is an enlarged cross-sectional view illustrating another sealing structure that employs a seal according to a second embodiment of the present invention.
Figure 8A:
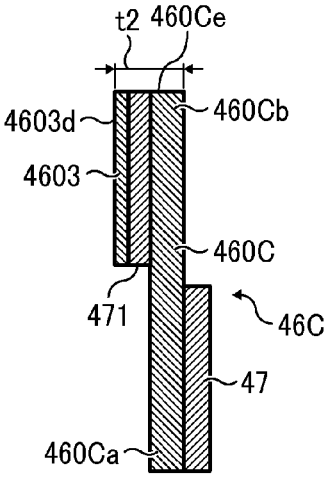
FIG. 8A is an enlarged cross-sectional view illustrating an exemplary configuration of a modification of the seal of the second embodiment according to one embodiment of the present invention.
Figure 8B:
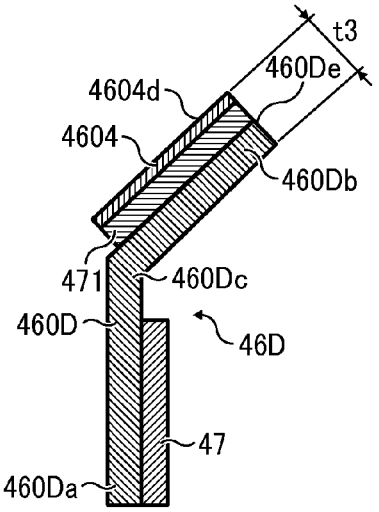
FIG. 8B is an enlarged cross-sectional view of the seal of the second embodiment of the present invention.

Now, a second embodiment of the present invention is described herein below with reference to FIG. 7. As shown there, an exemplary configuration of a developing unit 4A according to this embodiment is illustrated. Since a configuration of the developing unit 4A is the same as the developing unit 4 shown in FIG. 3 except for a configuration of an entrance seal unit, the entrance seal unit of this embodiment is only described herein below. Specifically, as shown in FIGS. 7 and 8B, the entrance seal unit 46D according to this embodiment includes a first seal 460D and a second seal 4604 located at a free end 460Db of the first seal 460D. The second seal 4604 has a different property from that of the first seal 460D. The second seal 4604 is pasted onto and superimposed on a free end 460Db of the first seal 460D via a double-faced tape 471 without protruding beyond an edge 460De thereof. Thus, a surface of the seal 4604 on the opposite side to the double-sided tape 471 serves a contact surface 4604*d* contacting the surface 41*a* of the developing roller 41. The base end 460Da of the first seal 460D is also pasted onto the developing unit housing 40 with a double-sided tape 47 so that the surface (i.e., the contact surface 4604*d*) of the second seal 4604 can contact the surface 41*a* of the developing roller 41.

As shown in FIG. 8B, an angled portion 460Dc is formed in the first seal 460D between the base end 460Da and the free end 460Db. A shape of the first seal 460D is the same as the seal 460 shown in FIG. 4B. However, between the base end 460Da of the first seal 460D and the developing unit housing 40, a backup sponge member 33 is provided to contact both the first seal 460D and the developing unit housing 40 to preferably adjust and set a prescribed amount of contact pressure (see FIG. 7). FIG. 8A illustrates a modification of the second embodiment of the present invention. An entrance seal unit 46C of this modification includes a first seal 460C and a second seal 4603 provided at a free end 460Cb of the first seal 460C having different properties from those of the first seal 460C. The second seal 4603 is pasted onto and superimposed on a free end 460Cb of the first seal 460C via a double-faced tape 471 without protruding beyond an edge 460Ce thereof. Accordingly, a surface of the seal 4603 on an opposite side to the double-sided tape 471 serves as a contact surface 4603*d* contacting the surface 41*a* of the developing roller 41. The base end 460Ca of the first seal 460C is pasted onto the developing unit housing 40 with the double-sided tape 47 so that the surface of the second seal 4603 can contact the surface 41*a* of the developing roller 41. In the modification of the entrance seal unit 46C, between a free end 460Cb of the first seal 460C and the developing unit housing 40, a backup sponge member 33 (see FIG. 7) is also provided to contact both the first seal 460C and the developing unit housing 40 to preferably adjust and set a prescribed amount of contact pressure.

Hence, in the entrance sealing units 46C and 46D each using the multiple seals, since conventional PET sheets are employed as first seals 460C and 460D acting as bases and are bent, contact pressure can be preferably set constantly, respectively. In addition, by using material having properties, such as abrasion resistance, conductivity, etc., for the second seals 4603 and 4604, the entrance sealing units 46C and 46D can obtain a prescribed property in accordance with usage purpose. Here, a molded sheet (sealing) member made of fluorocarbon resin having properties of pencil hardness of about 2H or more, a water drop contact angle of about 90 degrees or more, surface roughness (arithmetic mean roughness) Ra of about 0.10 or less, and thermal conductivity of about 2×10^−4 [Cal/cm·sec·degree Celsius] is used for each of the second seals 4603 and 4604. Accordingly, the entrance sealing units 46C and 46D can maintain sealing performance while likely preventing occurrence of a vertical stripe generally caused by toner adhesion.

Figure 9:
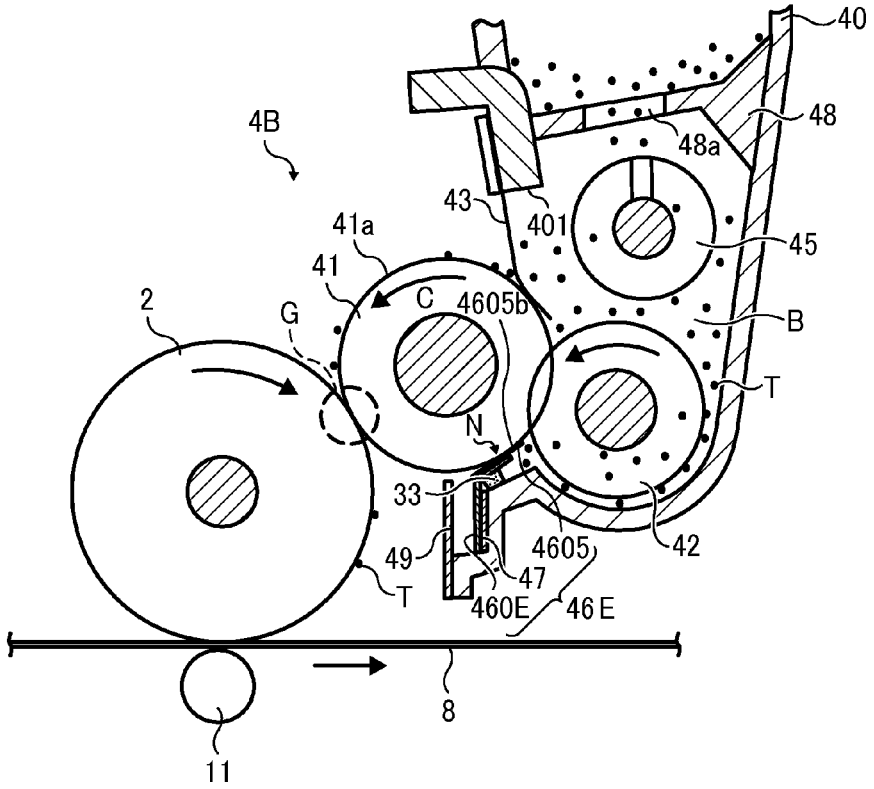
FIG. 9 is an enlarged cross-sectional view illustrating yet another seal structure including a seal according to a third embodiment of the present invention.
Figure 11:
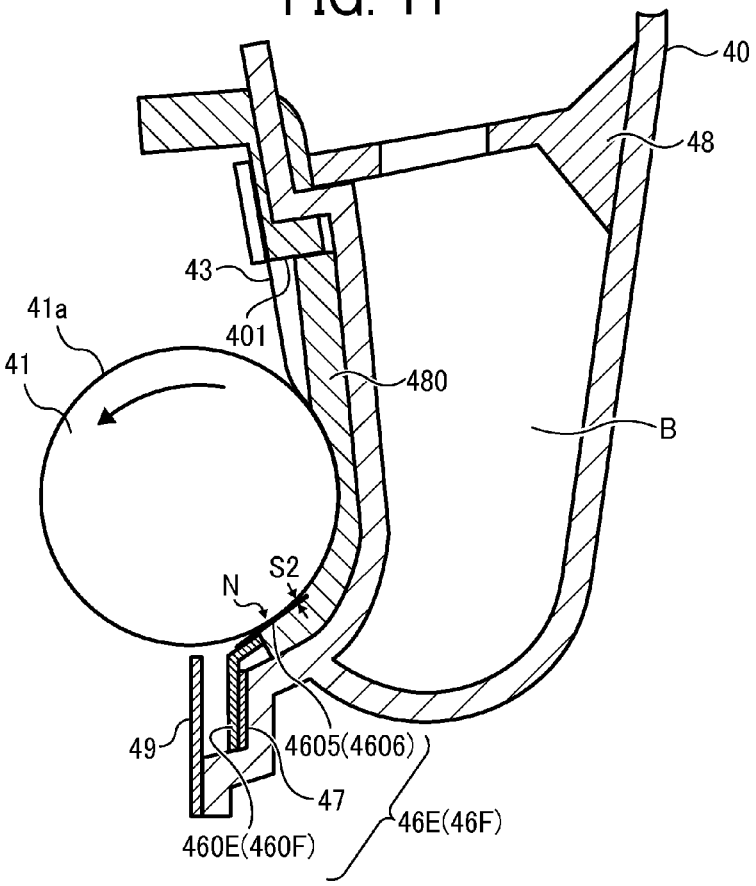
FIG. 11 is a cross-sectional view schematically illustrating advantage of the seal of the third embodiment shown in FIG. 10B.
Figure 12:
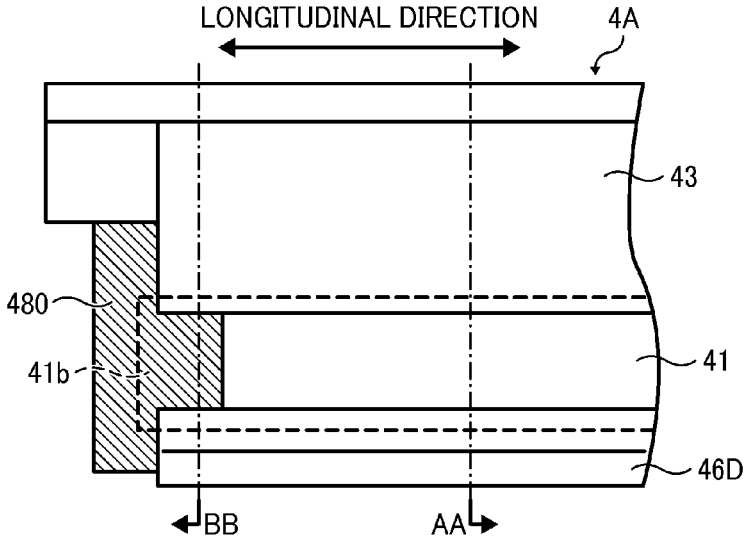
FIG. 12 is a diagram schematically illustrating the seal structure near one end of a developer bearer according to one embodiment of the present invention.
Figure 13:
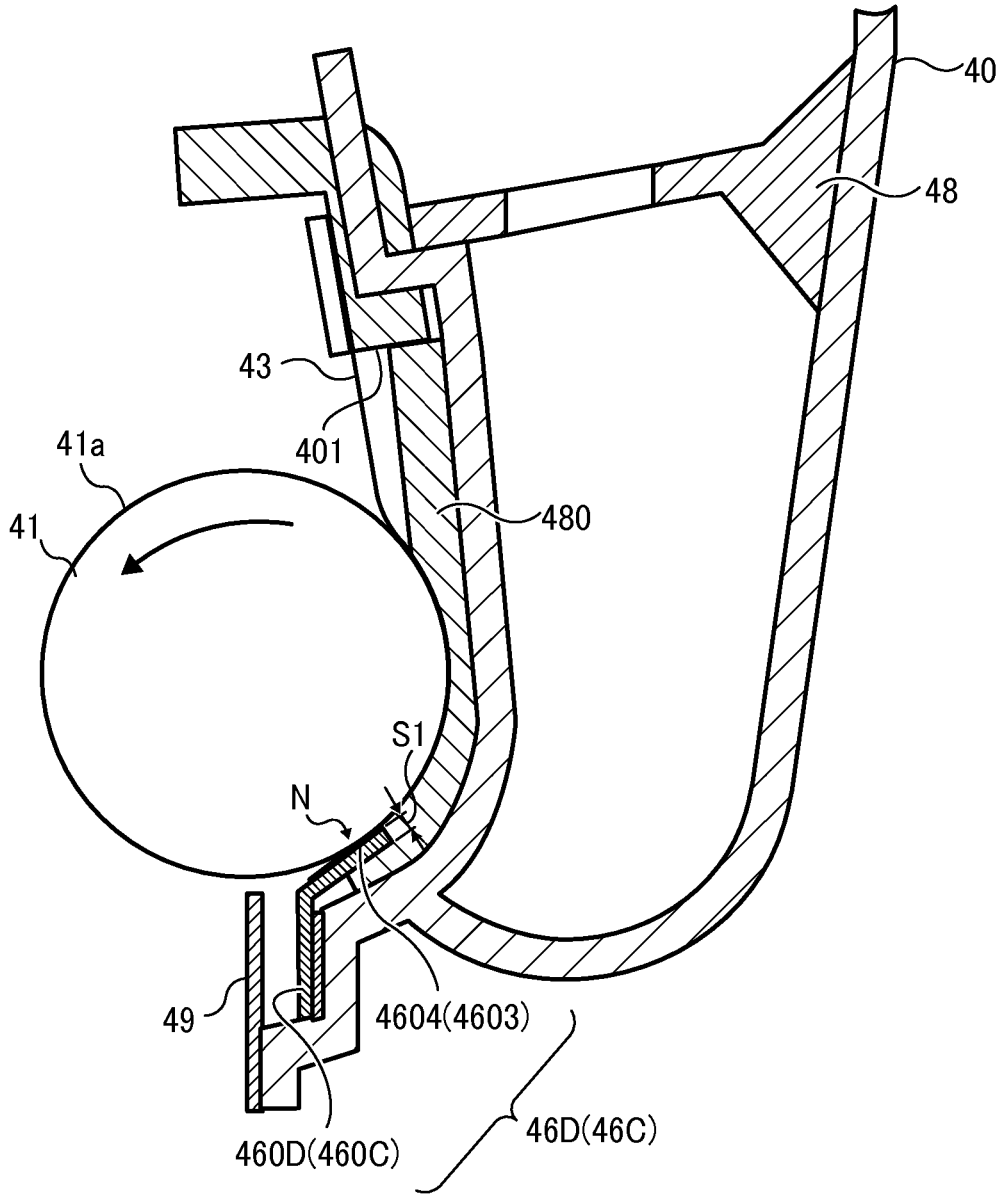
FIG. 13 is a cross-sectional view schematically illustrating a problem to be solved when a thicker seal is used.

Here, as shown in FIGS. 8A and 8B, thicknesses t2 and t3 of free ends 460Cb and 460Db of the entrance sealing units 46C and 46D contacting the surface 41*a* of the developing roller 41 are greater than those of the seals shown in FIGS. 4A and 4B by a total amount of thickness of the seals 4603 and 4604 and the double-sided tape 471, respectively. When the thicknesses t2 and t3 of the entrance sealing units 46C and 46D contacting the surface 41*a* of the developing roller 41 become greater in this way, a new challenge of toner leakage sometimes occurs at both ends in the longitudinal direction of the developing roller 41 as illustrated in FIG. 12. Specifically, FIG. 12 is a front view schematically illustrating an exemplary developing unit 4A. The developing unit 4A includes edge seals 480 near both ends (e.g., 41*b* and its opposite end) of the developing roller 41 in the longitudinal direction thereof to prevent toner T from leaking therefrom. However, only the free end 41*b* of the developing roller 41 in the longitudinal direction thereof is illustrated in FIG. 12. Here, FIGS. 3, 7, and 9 illustrate cross-sectional views taken at a position A of FIG. 12. Whereas, FIGS. 11 and 13 also illustrates cross-sectional views taken at a position B of FIG. 12. As shown in FIGS. 11 and 13, the edge seal 480 is disposed to block gaps between the developing unit housing 40 and the developing roller 41 at both ends 41*b* of the developing roller 41. The edge seal 480 is generally composed of either a sponge member alone having preferable sliding performance or the sponge member with a felt member and/or a hair transplant brush pasted onto a surface of the sponge member contacting the developing roller 41. In each of both ends, the entrance seal unit 46D is sandwiched by the developing roller 41 and the edge seal 480. Since the edge seal 480 is made of elastic material, such as sponge, etc., a gap between the tip of the entrance seal (46*d*) and the developing roller 41 is closed by deformation of the sponge member, so that the leakage of the toner T therefrom can be prevented. For this reason, the seal of the entrance seal unit 46D is made of PET having a thickness of from about 0.05 mm to about 0.15 mm. That is, an amount of contact pressure can be set within a desirable range to minimize the gap at the tip thereof as minimum as possible and suppress the leakage of toner T therefrom. However, in the configurations shown in FIGS. 8A and 8B, the thicknesses t2 and t3 grow at the free ends of the entrance sealing units 46C and 46D, respectively. Consequently, the gap 51 created at the tip of the entrance seal unit 460D and the developing roller 41 grows as shown in FIG. 13, and the toner T leaks from the end 41*b* of the developing roller 41 as a problem. Here, it is possible to simply minimize the thicknesses t2 and t3 by thinning the first seals 460C and 460D serving as the bases. However, when the first seals 460C and 460D serving as the bases are thinned, the contact pressure decreases as a result.

Then, according a third embodiment of the present invention as described herein below with reference to FIG. 9 and applicable drawing, an entrance seal unit is configured by a first seal and a second seal provided in the first seal while partially protruding beyond a free end of the first seal to contact a rotating body at its projecting portion. Since a configuration of the developing unit 4B is similar to that of the developing unit 4 shown in FIG. 3 except for a configuration of an entrance seal unit, only the configuration of the entrance seal unit is herein below described.

Figure 10A:
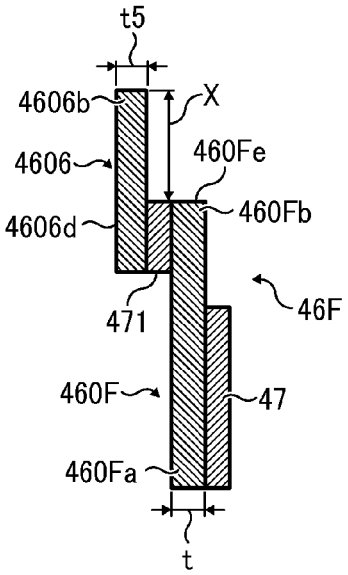
FIG. 10A is an enlarged cross-sectional view illustrating an exemplary configuration of a modification of the seal of the third embodiment according to one embodiment of the present invention.
Figure 10B:
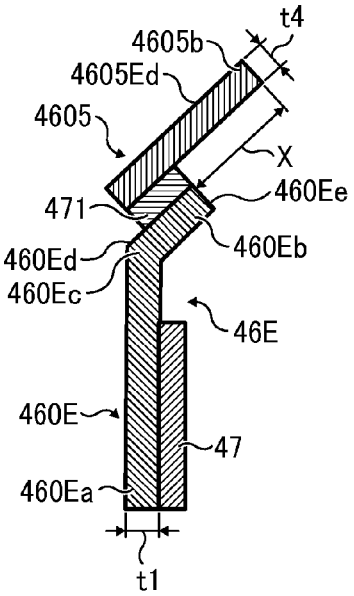
FIG. 10B is an enlarged cross-sectional view of the seal of the third embodiment of the present invention.

The entrance seal unit 46E according to this embodiment includes a first seal 460E and a second seal 4605 overlapped with the first seal 460E. As shown in FIG. 10B, the second seal 4605 is disposed in the first seal 460E while partially protruding beyond an edge 460Ee of a free end 460Eb of the first seal 460E. Whereas the base end 460Ea of the seal 460E is pasted onto the developing unit housing 40 with a double-sided tape 47 so that the projecting portion of the second seal 4605 contacts the surface 41*a* of the developing roller 41. As shown in FIG. 10B, an angled portion 460Ec is formed in the first seal 460E between the free end 460Eb and the base end 460Ea. The first seal 460E includes substantially the same shape as the seal 460 and 460C as shown in FIGS. 4B and 8B, respectively. Here, contact pressure is appropriately set by installing and bring a backup sponge member 33 in contact with both the developing unit housing 40 and the base end 460Ea of the first seal 460E therebetween. In this embodiment, the second seal 4605 is pasted onto a surface 460Ed of the first seal 460E to overlap therewith on a side of the free end 460Eb of the angled portion 460Ec thereof using a double-sided tape 471. More specifically, the second seal 4605 is pasted onto the first seal 460E so that a free end 4605*b* of the second seal 4605 protrudes from the edge 460Ee of the free end 460Eb (of the first seal 460E) and a surface of the free end 4605*b* opposite a surface onto which the double-sided tape 471 is pasted is brought in contact with the surface 41*a* of the developing roller 41 with pressure to provide a contact surface 4605Ed. That is, in the entrance seal unit 46E, the second seal 4605 is attached being displaced from the first seal 460E acting as the base to serve as a contact member. In the drawing, arrow X indicates an amount of projection (offset) of the second seal 4605 from the edge 460Ee of the first seal 460E to a tip of the free end 460Eb of the second seal 4605. Then, a range of the entrance seal unit 46E shown by arrow X is brought in contact with the surface 41*a* of the developing roller 41 as a contact section. Here, the first seal 460E is made of PET material. Whereas, the second seal 4605 is made of fluorocarbon resin having pencil hardness of about 2H or more, a water drop contact angle of about 90 degrees or more, surface roughness (arithmetic mean roughness) Ra of about 0.10 or less, and thermal conductivity of about 4×10^−4 [Cal/cm·sec·degree Celsius].

Accordingly, as shown in FIG. 11, a gap S2 created between the developing roller 41 and the tip of the entrance seal unit 46E, i.e., the second seal 4605, is only equivalent to a thickness t4 of the second seal 4605. Therefore, when the second seal 4605 having the same thickness t1 as the first seal 460E as shown in FIG. 10B is selectively employed, the contact pressure can be set to from about 10 N/m to about 45 N/m (more preferably, from about 15 N/m to about 35 N/m). In addition, since the gap S2 becomes narrower than the gap S1 as shown in FIG. 13, a different property can be provided to the entrance seal unit 46E while continuously setting the preferable contact pressure to the entrance seal unit 46E. Further, since the free end 460Eb does not need to be thickened, the toner leakage from the end 41*b* of the developing roller 41 can be likely prevented. Further, sealing performance can be ensured while preventing the toner T from being scraped off and adhering to the entrance seal unit 46E at the both ends of the entrance seal unit 46E at the same time.

Further, since the second seal 4605 that contacts the surface 41*a* of the developing roller 41 is also made of fluorine resin having pencil hardness of about 2H or more, a water drop contact angle of about 90 degrees or more, surface roughness (arithmetic mean roughness) Ra of about 0.10 or less, and thermal conductivity of about 4×10^−4 [Cal/cm·sec·degree Celsius], sealing performance can be maintained while likely preventing occurrence of a vertical stripe generally caused in an image by toner adhesion. Here, an entrance seal unit 46F shown in FIG. 10A illustrates a modification of the third embodiment of the present invention. In the entrance seal unit 46F, a double-sided tape 47 is pasted onto a base end 460Fa of a first seal 460F that acts as a base. Also, a second seal 4606 made of different material having different properties from the first seal 460F is pasted onto the first seal 460F at the other side 460Fb thereof using a double-sided tape 471. More specifically, the second seal 4606 is pasted onto (the first seal 460F) so that a free end 4606*b* of the second seal 4606 protrudes from an edge 460Fe of the free end 460Fb (of the first seal 460F), and a surface of the free end 4606*b* opposite a surface onto which the double-sided tape 471 is pasted is brought in contact with the surface 41*a* of the developing roller 41 to provide a contact surface 4606*d*. Specifically, in the entrance seal unit 46F, the second seal 4606 is attached being displaced from the first seal 460F that acts as a base to serve as a contact member. Hence, according to this embodiment, the entrance seal unit is not limited to the entrance seal unit 46E shown in FIG. 10B and can also employ the entrance seal unit 46F as shown in FIG. 10A as well.

In this modification, as shown in FIG. 11, a gap S2 created between the developing roller 41 and the tip of the entrance seal unit 46F is only equivalent to a thickness t5 of the second seal 4606. Therefore, when the second seal 4606 having the same thickness t1 as the first seal 460F is selectively employed, the contact pressure can be set to from about 10 N/m to about 45 N/m (more preferably, from about 15 N/m to about 35 N/m). In addition, since the gap S2 becomes narrower than the gap S1 as shown in FIG. 13, a different property can be provided to the entrance seal unit 46F while continuously setting the preferable contact pressure to the entrance seal unit 46F without thickening a free end 460Fb. Further, performance of preferably sealing can be ensured while preventing the toner T from being scraped off and adhering to the entrance seal unit 46E at the both ends of the entrance seal unit 46E at the same time. Here, the second seal 4606 that contacts the surface 41*a* of the developing roller 41 is also made of fluorine resin having pencil hardness of about 2H or more, a water drop contact angle of about 90 degrees or more, surface roughness (arithmetic mean roughness) Ra of about 0.10 or less, and thermal conductivity of about 4×10^−4 [Cal/cm·sec·degree Celsius]. Accordingly, sealing performance can be maintained while likely preventing occurrence of a vertical stripe generally caused in an image by toner adhesion. To this end, the toner leakage from the end 41*b* can be likely prevented.

Now, a fourth embodiment of the present invention is herein below described with reference to FIG. 14. Heretofore, in each of the first to third embodiments of the present invention, the seal of the present invention is applied to the entrance seal of each of the one component toner developing units 4, 4A, and 4B. However, in this fourth embodiment of the present invention, a seal of the present invention is applied to a developing unit having a developing sleeve acting as a rotating body to bear two-component developer.

Figure 14:
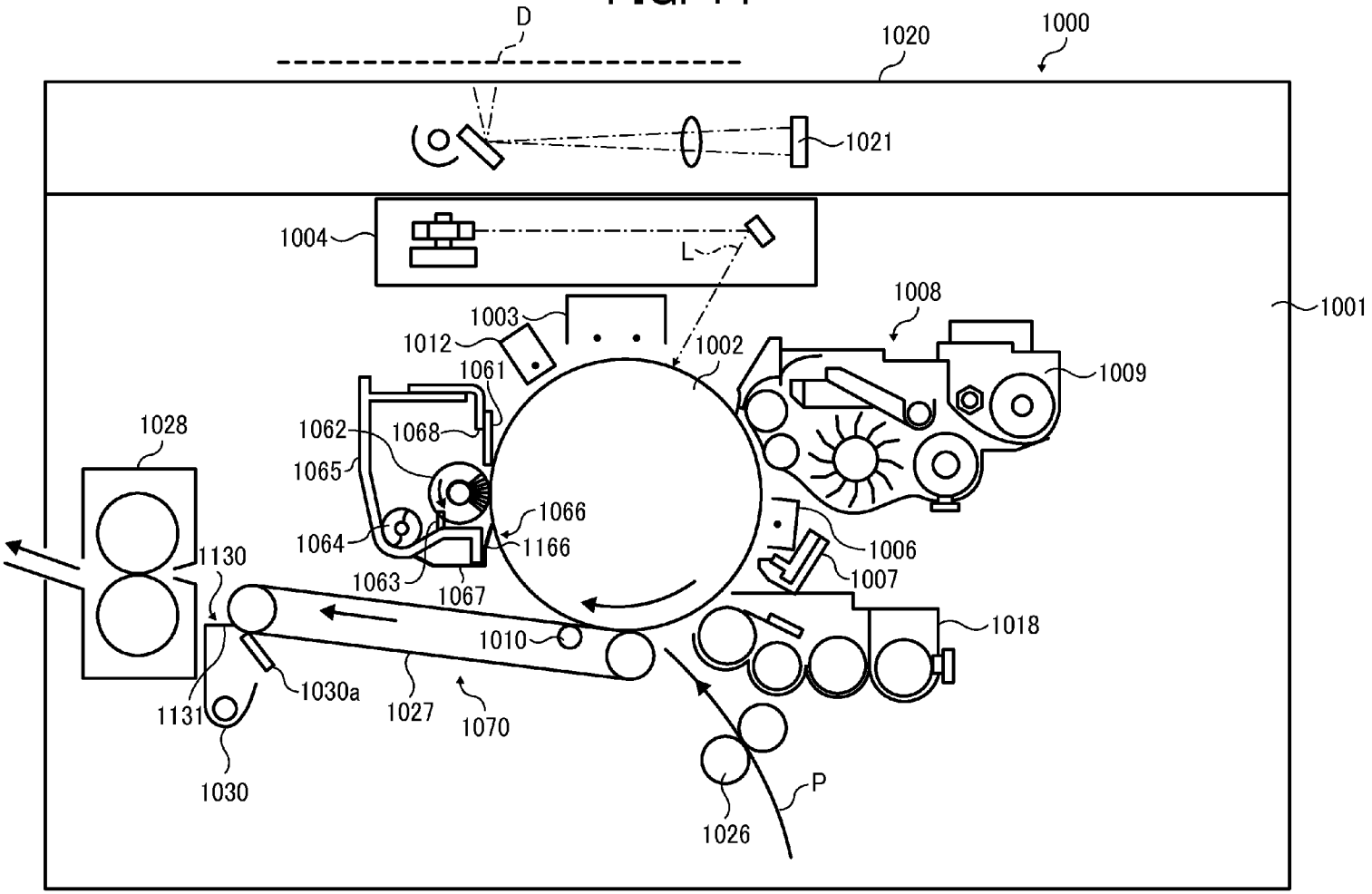
FIG. 14 is a diagram schematically illustrating another image forming apparatus, to which a seal according to the fourth embodiment of the present invention is applied, according to one embodiment of the present invention.

Specifically, an image forming apparatus 1000 shown in FIG. 14 is a copier capable of forming a dual color image. The image forming apparatus 1000 accommodates a photoconductive drum 1002 as a rotating body acting as an image bearer in an apparatus body 1001 (i.e., a body of an image forming apparatus 1000). Around the photoconductive drum 1002, a first electric charging unit 1003 that electrically charges the photoconductive drum 1002, an exposing unit 1004 that emits exposure light L based on image information of an original document D, a second electric charging unit 1006 that handles a second developing process, and an LED array 1007 (i.e., a second exposing unit) that handles a second developing process are disposed. Further disposed around the photoconductive drum 1002 are a developing unit 1008 that employs a two-component developing system and handles a first developing process, a toner supplying unit 1009 to supply the first developing unit 1008 with fresh toner, a transfer unit 1010 to transfer a toner image formed on the photoconductive drum 1002 onto an image transferred member P, a cleaning unit 1060 acting as a cleaning unit that removes un-transferred toner borne on the photoconductive drum 1002, an electric charge removing unit 1012 to remove a surface electrical potential borne on the photoconductive drum 1002, and a second developing unit 1018 that employs a single-component system and handles a second developing process.

Above the apparatus body 1001, an original document reading unit 1020 that reads image information of an original document D is positioned. The original document reading unit 1020 includes a CCD (i.e., charge coupled device as an imaging sensor) 1021 in which an image is optically formed based on image information of the original document D. At a bottom of the apparatus body 1001, a pair of registration rollers 1026 that conveys an image transferred member P toward a transfer unit 1010, a transfer unit 1070 with a transfer belt 1027 as a rotating body that leads the image transferred member P to a fixing unit 1028 after the transfer process, and a fixing unit 1028 that settles a toner image on the image transferred member P after the transfer process are disposed.

Now, image forming operation executed in the image forming apparatus 1000 with such a configuration is herein below described in detail. First of all, in the original document reading unit 1020, image information is optically read from the original document D placed thereon. Specifically, light reflected corresponding to image information of black color in the original document D and that corresponding to the image information of red color in the original document D are focused on the CCD 1021 via various optical elements, such as mirrors, lenses, optical filters, etc. The optical image information read by the original document reading unit 1020 is transmitted to an exposing unit 1004 via a memory control unit. Subsequently, exposure light L (i.e., a laser light beam) is emitted based on the black image information from the exposing unit 1004 onto the photoconductive drum 1002.

On the other hand, the photoconductive drum 1002 is driven by a driving motor, not shown, and rotates clockwise in the drawing. The, firstly, a surface of the photoconductive drum 1002 is electrically charged uniformly to bear −900 volts by a first electric charging unit 1003 that employs a scorotron charge system at a position opposed thereto. Subsequently, the surface of the photoconductive drum 1002 electrically charged at the first electric charging unit 1003 reaches an irradiation position receiving of the exposure light L. Then, at this position, an electrostatic latent image is formed corresponding to the image information of the black color. Here, the surface potential of the photoconductive drum 1002 in which the electrostatic latent image is formed is about 100 volts. After that, the surface of the photoconductive drum 1002 in which the electrostatic latent image is formed reaches a position facing the first developing unit 1008 (i.e., a developing region). Subsequently, black toner included in the two-component developer borne by a pair of developing rollers in the first developing unit 1008 adheres to the latent image borne on the photoconductive drum 1002, thereby forming a black toner image thereon (i.e., a first developing process). Here, to the developing roller of the first developing unit 1008, a developing bias having about −550 volts is applied. Also, a gap (i.e., a developing gap) having a distance from about 0.5 mm to about 1.0 mm is created between the developing roller and the photoconductive drum 1002. A toner supplying unit 1009 supplies toner to the first developing unit 1008 in accordance with a consumption amount of toner stored in the first developing unit 1008. A configuration and operation of the first developing unit 1008 is described later more in detail.

The surface of the photoconductive drum 1002, on which the black toner image is formed, is electrically charged again by a second electric charging unit 1006 at an opposite position thereto to bear about −900 volts. Then, the surface of the photoconductive drum 1002 electrically charged by the second electric charging unit 1006 reaches an irradiation position irradiated by an LED array 1007. Subsequently, at this position, an electrostatic latent image is formed corresponding to red image information. Here, a surface potential of the photoconductive drum 1002 is about −100 volts when the electrostatic latent image is formed thereon. The surface of the photoconductive drum 1002 bearing the second latent image in this way reaches a section opposed to the second developing unit 1018 (i.e., a developing region). Then, red toner (one-component non-magnetic developer) borne on the developing roller provided in the second developing unit 1018 as a rotating body adheres to a second latent image borne on the photoconductive drum 1002, thereby forming a red toner image (in a second developing process). Here, to the developing roller of the second developing unit 1018, a DC developing bias of −750 volts is applied.

The surface of the photoconductive drum 1002, on which both the black and red toner images are formed not mixed with each other reaches a position opposed to the transfer unit 1010. At this position, a toner image of dual colors borne on the photoconductive drum 1002 is transferred onto an image transferred member P conveyed by the pair of registration rollers 1026 thereto. At this moment, un-transferred toner (i.e., not transferred onto the image transferred member P) slightly remains on the photoconductive drum 1002. The surface of the photoconductive drum 1002 having passed the transfer unit 1010 with the un-transferred toner reaches a position opposed to a cleaning unit 1060. Accordingly, in the cleaning unit 1060, the un-transferred toner attached to the surface of the photoconductive drum 1002 is collected by a drum cleaning blade 1061 and a fur brush 1062 as well each contacting the photoconductive drum 1002. Subsequently, the surface of the photoconductive drum 1002 passing through the cleaning unit 1060 reaches the electric charge removing unit 1012. Hence, residual potential on the surface of the photoconductive drum 1002 is eliminated and thereby completing a series of image forming processes.

The image transferred member P is fed from a sheet feeding unit (not shown) that accommodates several transferred member P. Subsequently, the image transferred member P, which has arrived at the position of the pair of registration rollers 1026 after being fed from the sheet feeding unit, is timed and further conveyed to the transfer unit 1010 by the pair of registration rollers 1026 to synchronize with a toner image borne on a photoconductive drum 1002. Then, as described above, in the transfer unit 1010, the toner image is transferred onto the image transferred member P. The image transferred member P completing the transfer process in this way is carried by a transfer belt 1027 driven by a driving motor, not shown, traveling in a direction as shown by arrow in the drawing to the fixing unit 1028. Subsequently, in the fixing unit 1028, the un-fixed toner image on the image transferred member P is fixed thereto. Here, the transfer belt 1027 traveling in the direction as shown by arrow is cleaned by a transfer belt cleaning unit that includes a cleaning blade 1030*a* that contacts the transfer belt 1027 in a belt cleaning unit 1030. The image transferred member P completing the fixing process in this way is then discharged toward an outside of the apparatus body 1001 of the image forming apparatus 1000 as an output image. In this way, a series of image forming process is completed.

A driving motor provided to drive and rotate the photoconductive drum 1002 is controlled to slightly rotate the photoconductive drum 1002 in the opposite direction to a normal direction of rotation (i.e., counterclockwise in FIG. 14) after completing the above-described image forming process. Hence, impurities deposited on a contact surface of the cleaning blade 1061 are removed therefrom. Similarly, a driving motor provided to drive and rotate the transfer belt 1027 is controlled to slightly rotate the transfer belt 1027 in the opposite direction to a normal direction of rotation after completing the above-described image forming process as well. Hence, impurities deposited on a contact surface of the blade 1030*a* are similarly removed therefrom.

Figure 15:
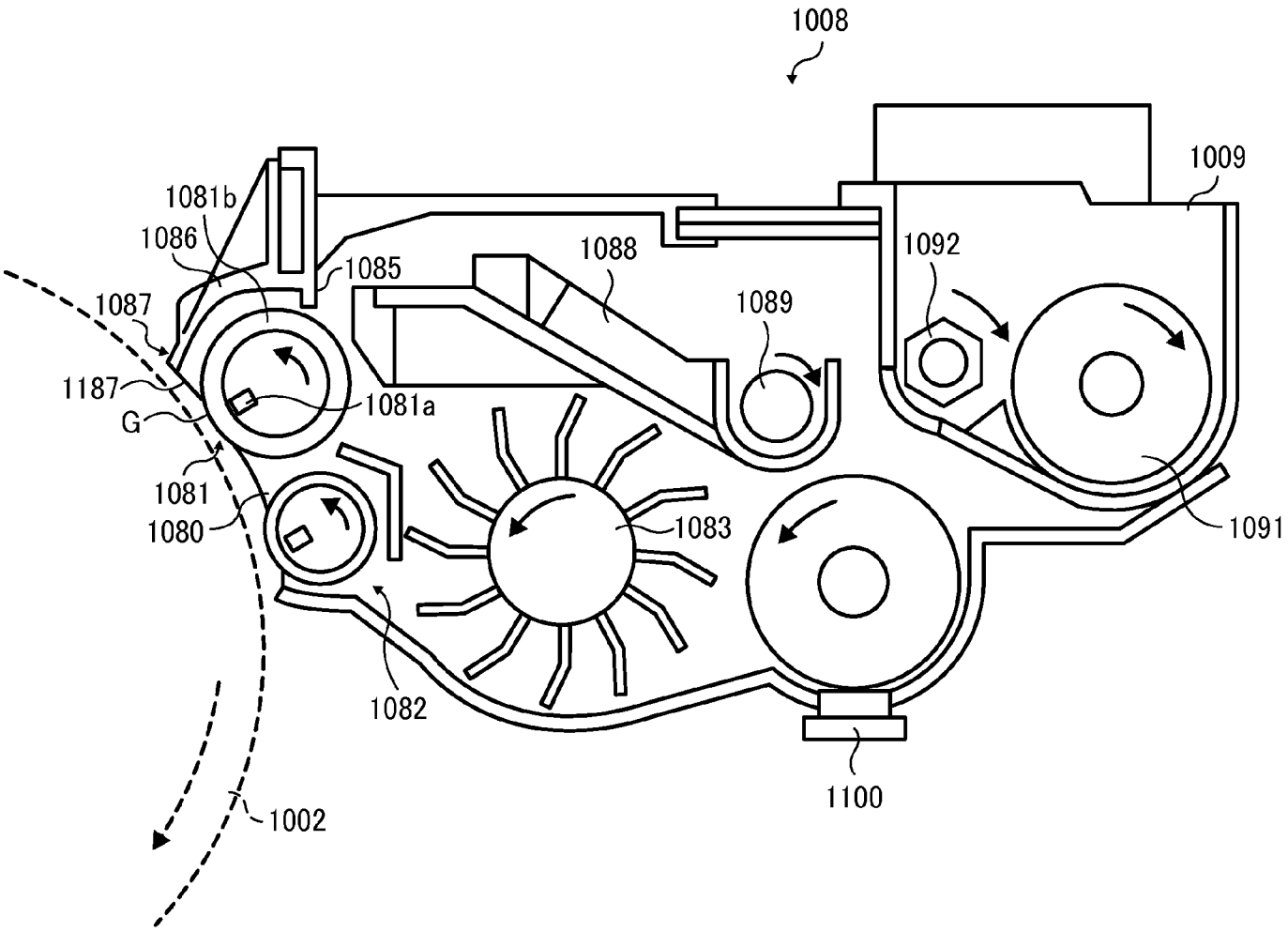
FIG. 15 is an enlarged view illustrating an exemplary configuration of a developing unit with a developing sleeve according to one embodiment of the present invention.

Now, with reference to a cross-sectional view of FIG. 15, an exemplary configuration of the first developing unit 1008 removably installed in the apparatus body 1001 is herein below described in detail. As shown there, in the first developing unit 1008, an opening 1080 is formed at a site therein opposed to the photoconductive drum 1002. The first and second developing rollers 1081 and 1082 are exposed to the photoconductive drum 1002 via this opening 1080 to respectively act as rotating developing bearers. To the first developing roller 1081, developer is supplied by a paddle roller 1083 as an agitation member. The first developing unit 1008 includes a stirring roller having multiple elliptical plates in its longitudinal direction, a doctor blade 1085 as a regulating member disposed with its tip being opposed to the first developing roller 1081, and a housing 1086 as a base in which an entrance seal unit 1087 is disposed as an seal unit. The developing unit 1008 also includes a stirring board 1088 and a conveying screw 1089 each for stirring developer stored therein in its longitudinal direction. It is to be noted here that, a reference code 1100 indicates a toner density sensor to control an amount of toner stored in the developing unit 1008.

Figure 16:
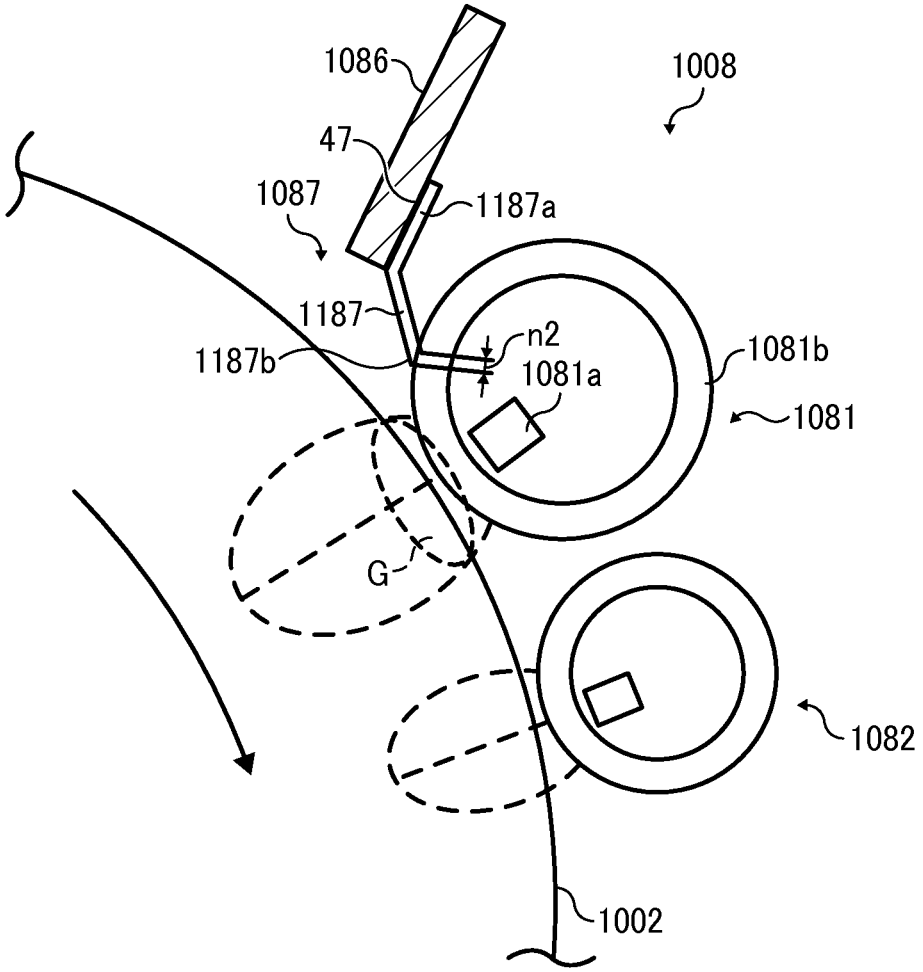
FIG. 16 is an enlarged view (partially) illustrating an exemplary configuration of an entrance seal unit located near the developing sleeve according to one embodiment of the present invention.

As shown in FIG. 16, the first developing roller 1081 includes a magnet 1081*a* secured thereto and a developing sleeve 1081*b* as a rotating body that rotates around the magnet 1081*a* or the like. By the magnet 1081*a* accommodated in the first the developing roller 1081 in this way, multiple-poles (a developer lifting pole, a developer conveying pole, a main pole, a developer cutting pole, or the like) are formed on the first developing roller 1081. Accordingly, when the developing sleeve 1081*b* rotates around the magnet 1081*a* forming the multiple-magnet poles, developer on the developing roller 1081 (i.e., on the developing sleeve 1081*b*) moves thereon as the developing sleeve 1081*b* rotates. Although not shown in the drawings, however, similar to the first developing roller 1081, the second developing roller 1082 is also composed of multiple magnets and a developing sleeve or the like as well.

Now, exemplary operation of the developing unit 1008 is herein below described more in detail. The pair of developing rollers 1081 and 1082 rotates in directions as shown by arrows shown in FIG. 15, respectively. Developer stored in the developing unit is stirred and mixed by the stirring roller, the conveying screw 1089, and the stirring board 1088 each rotating in directions as shown by arrows in both a longitudinal direction and a direction perpendicular thereto. Then, toner electrically charged by friction and thereby adsorbed to a carrier is supplied to the first developing roller 1081 by a paddle roller 1083 together with the carrier, and is borne on the first developing roller 1081. The toner stored in a toner supplying unit 1009 is conveyed to a position of a supplying roller 1092 by a stirring member 1091, and is supplied to the developing unit 1008 accordingly from the supplying roller 1092 through a supply mouth. Here, the toner stored in the toner supplying unit 1009 is supplied accordingly to the developing unit 1008 based on result of detection made by a toner density sensor 1100 that detects concentration of toner (i.e., percentage of toner in the developer) stored in the developing unit 1008.

The developer borne by the first developing roller 1081 are regulated by the doctor blade 1085 at a prescribed position thereof to bear an appropriate amount of developer and then reach a position opposed to the photoconductive drum 1002 (i.e., a developing region G) as shown in FIG. 16. After passing through the position opposed to the photoconductive drum 1002, the developer moves from the first developing roller 1081 to the second developing roller 1082 and reaches another position opposed to the photoconductive drum 1002 (i.e., a second developing region). Toner in the developer then adheres to the electrostatic latent image formed on the surface of the photoconductive drum 1002 at the other position opposed to the photoconductive drum 1002 (i.e., a second developing region). In this way, the developing process in the developing unit 1008 is completed.

The entrance seal unit 1087 is configured by a sheet of flexible seal 1187 to prevent toner from scattering through the opening 1080. The entrance seal unit 1087 is extended in a longitudinal direction of the opening 1080 (i.e., a direction perpendicular to plane of FIG. 16), and is pasted onto a housing 186 (installed upstream of the first developing roller 1081) with a double-sided tape 47. Specifically, a base end 1187*a* of the seal 1187 is pasted onto the opening 1080 of the housing 1086 with the double-sided tape 47, and a free end 1187*b* thereof is positioned to contact the surface of the developing sleeve 1081*b*.

In the entrance seal unit 1087 with such a configuration, when the seal 1187 having properties as described in the first to third embodiments is employed, toner leakage from the contact section can be likely prevented and accordingly sealing performance is ensured. Specifically, as a properties of the sheet (sealing) member 1187, pencil hardness is about 2H or more, a contacting angle of water drop is about 90 degrees or more, material is fluorocarbon resin, a surface roughness (arithmetic mean roughness) Ra is about 0.10 or less, and thermal conductivity is about 4×10^−4 [Cal/cm·sec·degree Celsius] or more again. That is, a sheet (sealing) member with such properties is molded and is brought in contact with the surface of the developing roller 1081 as a seal 1187 of the entrance seal unit 1087 in the developing unit 1008. In such a situation, as contact conditions, a width of a nip n2 formed between the developing sleeve 1081*b* and a free end 1187*b* of the sheet (sealing) member 1187 is set to from about 0.5 mm to about 2 mm, and contact pressure caused therebetween is set to from about 10 N/m to about 45 N/m. Hence, since contact pressure is suitable, sealing performance can be ensured. As a section to install the seal having the above-described various properties, it can be a cleaning unit 1060 with a cleaning blade 1061 that contacts the photoconductive drum 1002, for example.

Figure 17:
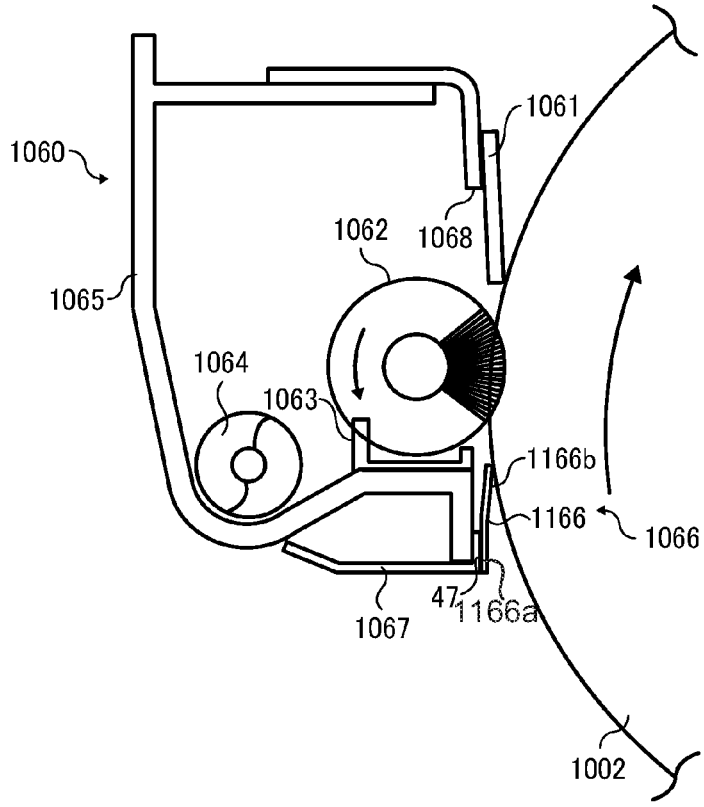
FIG. 17 is an enlarged diagram illustrating an exemplary configuration of a cleaning unit that cleans a photoconductive member and an entrance seal unit attached thereto according to one embodiment of the present invention.

That is, the cleaning unit 1060 includes a housing 1065 as a base in which an opening 1068 is formed at a position opposed to the photoconductive drum 1002 as shown in FIG. 17. From the opening 1068, a fur brush 1062 and a cleaning blade 1061 collectively acting as a cleaning unit are exposed to an outside thereof and are positioned to contact the surface of the photoconductive drum 1002. In a section of the opening 1068 located upstream of the fur brush 1062 in the rotational direction of the photoconductive drum 1002, an entrance seal unit 1066 is provided. The entrance seal unit 1066 is composed of a sheet of seal 1166 and contacts the photoconductive drum 1002 via its free end 1166*b* extended in a rotational direction of the photoconductive drum 1002. The seal 1166 is provided to allow transfer residual toner and sheet dust borne on the photoconductive drum 1002 to smoothly pass it through toward downstream thereof in the rotational direction of the photoconductive drum 1002 while preventing toner from scattering from the housing 1065 to an outside thereof.

In the cleaning unit 1060 configured in this way, when the photoconductive drum 1002 completes a transfer process of transferring the toner image and further rotates clockwise, the transfer residual toner and the sheet dust passing through the entrance seal unit 1066 are removed by the fur brush 1062 and the cleaning blade 1061 from the surface of the photoconductive drum 1002. The transfer residual toner and the sheet dust adhering to the fur brush 1062 are separated therefrom as the fur brush 1062 is pounded by a flicker 1063 and are further conveyed toward a recovery coil 1064. Since a base end 1166*a* of it is pasted onto the entrance seal holder 1067 attached to the housing 1065 with a double-sided tape 47, the seal 1166 is supported thereon. The seal 1166 extended toward the photoconductive drum 1002 contacts the surface of the photoconductive drum 1002 via its free end 1166*b*.

In this cleaning unit 1060, by using the seal 1166 made of fluorocarbon resin having properties of pencil hardness of about 2H or more, a contacting angle of water drop of about 90 degrees or more, a surface roughness (arithmetic mean roughness) Ra of about 0.10 or less, and thermal conductivity of about 4×10^−4 [Cal/cm·sec·degree Celsius] or more, toner leakage from the contact section can be prevented and good sealing performance is ensured.

Figure 18:
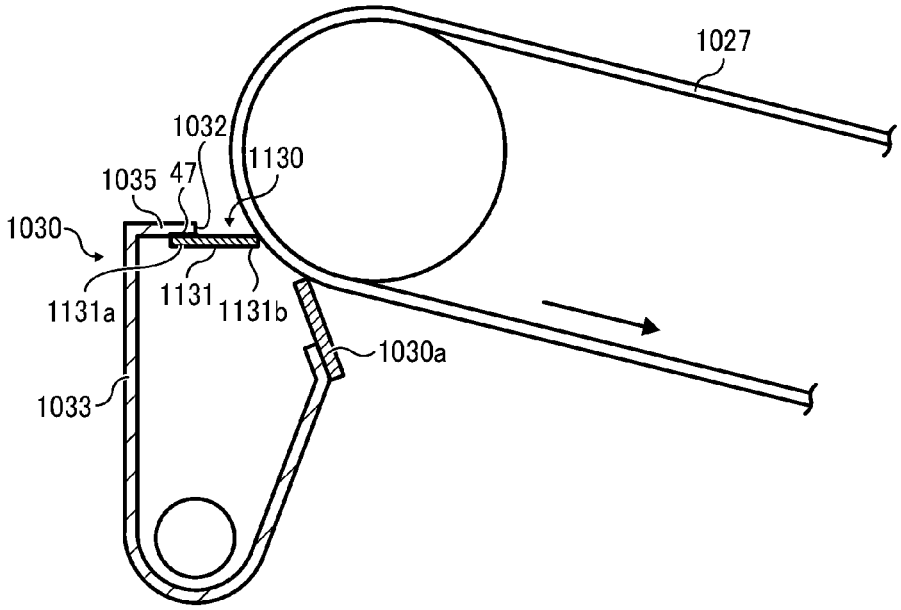
FIG. 18 is an enlarged diagram illustrating an exemplary configuration of a cleaning unit that cleans a transfer belt and an entrance seal unit attached thereto according to one embodiment of the present invention.

Further, the seal according to one of various embodiments of the present invention may be also applied to an entrance seal unit 1130 provided in a belt cleaning unit 1030 that employs a cleaning blade 1030*a* as a cleaning unit as shown in FIG. 18. Specifically, the belt cleaning unit 1030 includes a housing 1033 as a base in which an opening 1032 is formed at a position opposed to the transfer belt 1027 as shown in FIG. 18. From the opening 1032, the cleaning blade 1030*a* is exposed to an outside thereof and is positioned to contact the surface of the transfer belt 1027. In a portion of the opening 1068 located upstream of the transfer belt 1027 in a rotational direction of the transfer belt 1027, an entrance seal unit 1066 (1130) is provided. The entrance seal unit 1066 (1130) is composed of a sheet of seal 1131 contacting the transfer belt 1027 via its free end 1131*b*. The seal 1131 is provided to allow transfer residual toner and sheet dust borne on the transfer belt 1027 to smoothly pass it through toward downstream thereof in the rotational direction of the transfer belt 1027 while preventing toner from scattering from the housing 1033 to an outside thereof. Since the base end 1131*a* of it is pasted onto an entrance seal holder 1035 attached to the housing 1033 with a double-sided tape 47, the seal 1131 is supported thereon. The seal 1131 extended toward the transfer belt 1027 contacts the surface of the transfer belt 1027 via its free end 1166*b*.

In this belt cleaning unit 1030, by using the seal 1131 made of fluorocarbon resin having properties of pencil hardness of about 2H or more, a contacting angle of water drop of about 90 degrees or more, a surface roughness (arithmetic mean roughness) Ra of about 0.10 or less, and thermal conductivity of about 4×10^−4 [Cal/cm·sec·degree Celsius] or more, toner leakage from the contact section can be prevented and good sealing performance is ensured. Although the photoconductive drum 1002 is illustrated as a rotary image bearer in the above-described various embodiments, it can be a photoconductive belt as well.

Now, a method of preparing the toner T used in the above-described various embodiments is herein below described in detail. Initially, a first polyester is synthesized as described below. Into a reactor vessel to which a cooling pipe, an agitator, and a nitrogen introduction pipe are attached, 235 parts of bisphenol A-ethylene oxide-2-mole appendix, 525 parts of bisphenol A-propylene oxide 3-mole appendix, 205 parts of terephthalic acid, 47 parts of adipic acid, and 2 parts of jibtylchin oxide are input. Then, eight hours of chemical reaction is performed under ordinary pressure and room temperature of about 230 degrees Celsius. Subsequently, five hours of chemical reaction is performed under decreased pressure of from about 10 mmHg to about 15 mmHg. After that, 46 parts of anhydrotrimellic acid is input into the reactor vessel and chemical reaction is performed for two hours under ordinary pressure and room temperature of about 180 degrees Celsius, so that the first polyester is obtained. The first Polyester includes the number average molecular weight of about 2,600, a weight average molecular weight of about 6,900, a glass transition point Tg of about 44 degrees Celsius, and the acid value of about 26.

Next, a first prepolymer is synthesized as described below. Into a reactor vessel, to which a cooling pipe, an agitator, and a nitrogen introduction pipe are attached, 682 parts of bisphenol A-ethylene oxide-2-mole appendix, 81 parts of bisphenol A-propylene oxide 2-mole appendix, 283 parts of terephthalic acid, 22 parts of anhydrotrimellic acid, and 2 parts of jibtylchin oxide are input. Then, eight hours of chemical reaction is performed under ordinary pressure and room temperature of about 230 degrees Celsius. Subsequently, five hours of chemical reaction is performed under decreased pressure of from about 10 mmHg to about 15 mmHg, so that a first intermediate Polyester is obtained. Here, the first intermediate Polyester includes the number average molecular weight of about 2,100, a weight average molecular weight of about 9,500, a glass transition point Tg of about 55 degrees Celsius, an acid value of about 0.5, and a hydroxyl group number of about 49. Subsequently, into a reactor vessel, to which a cooling pipe, an agitator, and a nitrogen introduction pipe are attached, 411 parts of the first intermediate polyester, 89 parts of isophorone diisocyanate, and 500 parts of ethyl ester are input. Then, five hours of chemical reaction is performed in room temperature of about 100 degrees Celsius so that the first prepolymer is obtained. Here, a free isocyanate weight % of the first prepolymer is about 1.53%.

Now, a first master batch is produced as described below. Forty parts of carbon black (Regal 400R manufactured by Cabot Corp.), 60 parts of polyester resin as binder resin (RS-801 manufactured by Sanyo Chemical having an acid value 10, an Mw (weight average molecular weight) of 20,000, and a Tg (grass transition point) of 64 degrees Celsius), and 30 parts of water are mixed by Henschel mixer, so that a mixture in which water is infiltrated into the pigment aggregation is obtained. Then, the mixture is kneaded for 45 minutes by a pair of rolls having a surface temperature set to about 130 degrees Celsius, and is crushed by a pulverizer into grains each having a size of about 1 mm, so that a first master batch is obtained.

Now, a first pigments and wax dispersion solution (oil phase) is produced as described below. Into a vessel, to which a stirring rod and a thermometer are set, 545 parts of first polyester, 181 parts of paraffin wax, and 1,450 parts of ethyl acetate are input and stirred while warming them up to about 80 degrees Celsius for about 5 hours. Then, the mixture is cooled down to about 30 degrees Celsius within one hour. Subsequently, 500 parts of a first master batch, 100 parts of a first electric charge control agents, and 100 parts of ethyl acetate are input into the vessel. Such preparation is then mixed for 1 hour, so that a first raw material solution is obtained. Then, 1500 parts of the first raw material solution liquid is poured into a vessel, and carbon black and wax are dispersed therein by using a bead mill (e.g. Ultra-visco mill manufactured by AIMEX Co., Ltd.) under conditions in that a solution sending speed is about 1 kg/hr, a disk peripheral speed is about 6 m/s, and an amount of 80 cubic volume % of zirconia beads of 0.5 mm is filled, and the number of passage times is about three.

Next, 425 and 230 parts of the first polyester are added to the mixture and are collectively passed through the bead mill once under the above-described conditions thereof, so that the first pigment and wax dispersion solution is obtained. Then, the first pigment and wax dispersion solution is regulated so that a solid content thereof becomes about 50% (about 130 degrees Celsius, about 30 minutes). Then, an aqueous phase preparing process is executed as described below. Specifically, 970 parts of ion exchange water, 40 parts of 25 wt % aqueous dispersion liquid of dispersion stabling fine organic resin particles (e.g., copolymers of sodium salt of styrene-methacrylate-butyl acrylate-methacrylate ethylene oxide added sulfate), and 140 parts and 90 parts of 48.5% solution of dodecyl diphenyl ether disulfonic acid sodium (e.g., Eleminol MON-7 produced by Sanyo Chemical Industries, Ltd.) are mixed and stirred, so that milky-white liquid is obtained as a first aqueous phase. Then, an emulsification process is executed as described below. First, 975 parts of the first pigments and wax dispersion solution and 2.6 parts of isophoronediamine are mixed by a TK homo mixer (manufactured by PRIMIX Corporation) at about 5,000 rpm for about 1 minute. Then, 88 parts of the first prepolymer is added to the mixture and are further collectively mixed by the TK homo mixer at about 5,000 rpm for about 1 minute. Then, 1200 parts of the first aqueous phase of the milky-white liquid is added to the mixture and further mixed by the TK homo mixer at the number of rotations of from about 8,000 rpm to about 13,000 rpm for about 20 minutes, so that a first emulsion slurry is obtained.

Now, a solvent free process is executed as described below. Into a container provided with an agitator and a thermometer, a first emulsion slurry is input and a solvent free process is applied thereto at about 30 degrees Celsius for about eight hours, so that a first dispersed slurry is obtained.

Now, washing and drying processes are executed as described below. After filtration of 1000 parts of the first distributed slurry under decreased pressure, the following processes are executed. First, 100 parts of ion exchange water is added to a filter cake, and are mixed by the TK homo mixer (for about 10 minutes at the number of rotations of about 12,000 (rpm)), and are then subjected to filtration to obtain a filtrate. At this moment, the filtrate is creamy-white. Secondly, to the above-described filter cake, 900 parts of ion exchange water is added and mixed therewith by the TK homo mixer while applying ultrasonic vibration thereto (for about 30 minutes at the number of rotations of about 12,000 rpm (revolutions per minute)). The mixture is then subjected to filtration under decreased pressure. This operation is repeated so that (until) electric conductivity of the reslurry fluid becomes about 10 μC/cm or less. Thirdly, 10% hydrochloric acid is added so that pH (hydrogen power) of the above-described reslurry liquid becomes about 4, and is stirred therewith by a three-one motor (i.e., a mixing motor) for about 30 minutes. The mixture is then filtered. Fourthly, to the above-described filter cake, 100 parts of ion exchange water is added and is mixed therewith by the TK homo mixer (at a number of rotations of about 12,000 (rpm) for about 10 minutes). Then, the mixture is subjected to a filtrate process thereafter. The above-described operation is repeated so that (until) electric conductivity of the reslurry liquid becomes about 10 μs C/cm or less, so that a first filtration cake is obtained. Then, the first filtration cake is dried at about 42 degrees Celsius for about 48 hours in an ambient wind drying machine, and is sieved by a mesh having of an opening about 75 μm, so that mother toner is obtained. Specifically, the mother toner includes an average circular degree of about 0.974, a volume average grain size (Dv) of about 6.3 μm, a number average particle size (Dp) of about 5.3 μm, and a particle size distribution Dv/Dp of about 1.19. To 100 parts of the mother toner obtained by the above-described process, 1 part of commercially available fine silica powder H20TM [manufactured by Clariant Japan Corp., with a mean primary particle size of about 12 nm not processed by silicone oil], and 2 parts of RY50 [manufactured by Japan Aerosil Corp., having a mean primary particle size of about 40 nm processed by silicone oil] are mixed by the Henschel mixer. Then, by letting the mixture pass through a sieve having an opening about 60 μm and thereby removing coarse particles and aggregates, toner is obtained. Acceleration coagulation (of the toner) is then measured and is found to be about 54.4% by executing the following steps.

Now, a method of measuring a glass transition point is described. To measure the glass transition point of polyester resin or vinyl copolymer resin and the like, a differential scanning calorimeter (e.g., DSC-6220R manufactured by Seiko Instruments Inc.) is used as described below. First, the polyester resin or vinyl copolymer resin is heated from room temperature up to about 150 degrees Celsius at a heating rate of about 10 degrees Celsius/min. Then, the polyester resin or vinyl copolymer is left as is at about 150 degrees Celsius for about 10 minutes and is cooled down to the room temperature and is left again for about 10 minutes. The polyester resin or vinyl copolymer is heated again at a heating rate of about 10 degrees Celsius/min up to about 150 degrees Celsius. Hence, the glass transition point can be sought by finding an intersection between a baseline below the glass transition point and a tangent to a curvature portion indicating glass transition.

As described heretofore, according to one aspect of the present invention, since a seal that contacts a rotating body includes properties of pencil hardness of about 2H or more and a water drop contact angle of about 90 degrees or more, the seal can obtain preferable sealing performance while preventing toner from firmly sticking to a portion thereof contacting the rotating body.

According to another aspect of the present invention, the seal can obtain more preferable sealing performance while preventing toner from firmly sticking to a portion thereof contacting the rotating body, because the seal is made of fluorine resin.

According to yet another aspect of the present invention, the seal can obtain more preferable sealing performance while preventing toner from firmly sticking to a portion thereof contacting the rotating body, because surface roughness Ra of the seal is about 0.10 or less.

According to yet another aspect of the present invention, the seal can obtain more preferable sealing performance while preventing toner from firmly sticking to a portion thereof contacting the rotating body, because thermal conductivity of the seal is about 4×10^ −4 [Cal/cm. sec. degree Celsius] or more.

According to yet another aspect of the present invention, the seal can obtain more preferable sealing performance while preventing toner from firmly sticking to a portion thereof contacting the rotating body, because the seal includes a first sealing element attached to a base of the image forming apparatus and a second sealing element attached to the first sealing element overlying thereof.

According to yet another aspect of the present invention, the seal can obtain more preferable sealing performance while preventing toner from firmly sticking to a portion thereof contacting the rotating body, because the second sealing element includes a protrusion protruding beyond a free end of the first sealing element opposite a base end thereof attached to the base of the image forming apparatus while contacting the rotating body.

According to yet another aspect of the present invention, the seal can obtain more preferable sealing performance while preventing toner from firmly sticking to a portion thereof contacting the rotating body, because the second sealing element is fixed to the first sealing element with double sided tape.

According to yet another aspect of the present invention, the seal can obtain more preferable sealing performance while preventing toner from firmly sticking to a portion thereof contacting the rotating body, because a thickness of the second seal is about 0.15 mm or less.

According to yet another aspect of the present invention, the seal can obtain more preferable sealing performance while preventing toner from firmly sticking to a portion thereof contacting the rotating body, because the first sealing element includes an angled portion between the free and base ends thereof and the second sealing element is fixed to the first sealing element on a side of the free end of the angled portion thereof.

According to yet another aspect of the present invention, a developing unit installed in an image forming apparatus can obtain preferable sealing performance while preventing toner from firmly sticking to a portion of a seal contacting either a developing roller or a developing sleeve. Because, the developing unit includes a housing, a developing roller to bear one-component toner or a developing sleeve to bear two-component developer including toner and carrier particles each as a rotating body, and the above-described seal contacting either the developing roller or developing sleeve. Further because, pencil hardness of the seal is about 2H or more and a water drop contact angle thereof is about 90 degrees or more.

According to yet another aspect of the present invention, the developing unit can obtain more preferable sealing performance while preventing toner from firmly sticking to the portion of the seal contacting the developing roller. That is, the developing roller includes.

According to yet another aspect of the present invention, the developing unit can obtain more preferable sealing performance while preventing toner from firmly sticking to the portion of the seal contacting the developing roller. That is, a width of a contact nip formed between the developing roller or the developer sleeve and the seal is from about 0.5 mm to about 2 mm.

According to yet another aspect of the present invention, the developing unit can obtain more preferable sealing performance while preventing toner from firmly sticking to the portion of the seal contacting the developing roller. That is, an amount of contact pressure generated between the developing roller or the developer sleeve and the seal is from about 10 N/m to about 45 N/m.

According to yet another aspect of the present invention, the developing unit can obtain more preferable sealing performance while preventing toner from firmly sticking to the portion of the seal contacting the developing roller. Because, the one-component toner or toner of the two-component developer includes inorganic oxide mainly with silica by 2% or more as an external additive. Further because, a glass transition point is about 60 degrees Celsius.

According to yet another aspect of the present invention, a cleaning unit installed in an image forming apparatus can obtain preferable sealing performance while preventing toner from firmly sticking to a portion of the seal contacting either a photoconductive drum or a photoconductive belt. That is, the cleaning unit includes a housing, a cleaner, and the above-described seal provided in the housing to contact either a photoconductive drum or a photoconductive belt as the rotating body to seal the housing.

According to yet another aspect of the present invention, a transfer belt cleaning unit installed in an image forming apparatus can obtain preferable sealing performance while preventing toner from firmly sticking to a portion of the seal contacting a transfer belt. That is, the transfer belt cleaning unit includes a housing, a transfer belt cleaner installed in the housing, and the above-described seal provided in the housing to contact a transfer belt as the rotating body to seal the housing.

According to yet another aspect of the present invention, a process cartridge detachably attached to an image forming apparatus can obtain preferable sealing performance while preventing toner from firmly sticking to a portion of a seal. That is, the process cartridge includes at least one of a developing unit, a cleaning unit, and a transfer belt cleaning unit each including a housing and the above-described seal provided in the housing to seal the housing.

Numerous additional modifications and variations of the present invention are possible in light of the above teachings. It is therefore to be understood that within the scope of the appended claims, the present invention may be executed otherwise than as specifically described herein. For example, the seal, the developing unit, the cleaning unit, the transfer belt cleaning unit, the process cartridge, and the image forming apparatus are not limited to the above-described various embodiments and may be altered as appropriate. Similarly, the image forming method is not limited to the above-described embodiment and may be altered as appropriate. In particular, an order of various steps of the image forming method is not limited to the above-described embodiment and may be altered as appropriate.

What is claimed is:

1. An image forming apparatus comprising:

a housing configured to store toner;

a developing roller with a rotating surface configured to receive the toner;

a first sealing element having a lower portion including a base attached to the housing, an upper portion supported by a backing member between the upper portion and the housing; and a second sealing element adhered to the upper portion of the first sealing element;

wherein a front surface of the second sealing element contacts the developing roller and comprises a pencil hardness of 2H or more and a water drop contact angle of 90 degrees or more.

2. The image forming apparatus of claim 1, wherein the second sealing element is made of fluorine resin.

3. The image forming apparatus of claim 1, wherein surface roughness Ra of the second sealing element is 0.10 or less.

4. The image forming apparatus of claim 1, wherein thermal conductivity of the second sealing element is 4×10^−4 [Cal/cm·sec·degree Celsius] or more.

5. The image forming apparatus of claim 1, wherein the first sealing element further includes a central portion between the upper portion and the lower portion.

6. The image forming apparatus of claim 5, wherein the central portion of the first sealing element includes a bend such that the upper portion and the lower portion of the first sealing element are bent at an angle with respect to each other.

7. The image forming apparatus of claim 1, wherein the second sealing element is fixed to the first sealing element with double sided tape.

8. The image forming apparatus of claim 1, wherein a thickness of the second sealing element is about 0.15 mm or less.

9. The image forming apparatus of claim 1, wherein a width of a contact nip formed between the developing roller and the second sealing element is between 0.5 mm and 2 mm.

10. The image forming apparatus of claim 1, wherein an amount of contact pressure generated between the developing roller and the seal is between 10 N/m and 45 N/m.

11. The image forming apparatus of claim 1, wherein the toner comprises one-component toner or two-component developer and includes inorganic oxide mainly with silica by 2% or more as an external additive, wherein a glass transition point is about 60 degrees Celsius.

12. The image forming apparatus of claim 1, comprising:

a cleaner housing; and a transfer belt cleaner installed in the cleaner housing;

wherein the second sealing element is in the cleaner housing to contact the developing roller and seal the cleaner housing.

13. The image forming apparatus of claim 1, further comprising:

a process cartridge detachably attached to the image forming apparatus.

14. A method of forming an image, the method comprising the steps of:

forming a latent image on an image bearer;

developing the latent image into a toner image;

transferring the toner image onto a recording sheet;

fixing the toner image on the recording sheet; and cleaning the image bearer after the toner image is transferred onto the recording sheet, wherein the steps of developing the latent image and cleaning the image bearer are executed by using at least one of a developing unit and a cleaning unit each having a housing;

wherein a first sealing element includes a lower portion with a base attached to the housing, and includes an upper portion supported by a backing member between the upper portion and the housing;

wherein a second sealing element is adhered to the upper portion of the first sealing element;

wherein a front surface of the second sealing contacts the developing roller; and wherein the second sealing element comprises a pencil hardness of 2H or more and a water drop contact angle of 90 degrees or more.

* * * * *